US005474012A

United States Patent [19]

Yamada et al.

[11] Patent Number: 5,474,012

[45] Date of Patent: Dec. 12, 1995

[54] AUTOMATIC CONTROL FOR TRIM TABS

[75] Inventors: Hidemitsu Yamada; Takeo Omori; Masami Tanaka, all of Tokyo; Nobuo Makihara, Yokosuka; Atsushi Yonezawa, Yokohama, all of Japan

[73] Assignees: Nissan Motor Co., Ltd., Yokohama; Tokimec Inc., Tokyo, both of Japan

[21] Appl. No.: 301,900

[22] Filed: Sep. 7, 1994

[30] Foreign Application Priority Data

Sep. 7, 1993 [JP] Japan ..... 5-221844

[51] Int. Cl.[6] ..... B63B 1/22

[52] U.S. Cl. ..... 114/286; 440/1

[58] Field of Search ..... 440/1, 57, 61; 114/284, 285, 286, 287

[56] References Cited

U.S. PATENT DOCUMENTS

| | | | |
|---|---|---|---|
| 3,468,282 | 9/1969 | Wintercom | 440/61 |
| 3,834,345 | 9/1974 | Hager et al. | 440/57 |
| 4,318,699 | 3/1982 | Wenstadt et al. | 440/1 |
| 4,565,528 | 1/1986 | Nakase | 440/1 |
| 4,657,513 | 4/1987 | Baker | 440/66 |
| 4,718,872 | 1/1988 | Olson et al. | 440/1 |
| 5,169,348 | 12/1992 | Ogiwara et al. | 440/1 |
| 5,263,432 | 11/1993 | Davis | 440/1 |
| 5,352,137 | 10/1994 | Iwai et al. | 440/1 |

FOREIGN PATENT DOCUMENTS

| | | |
|---|---|---|
| 3-82697 | 4/1991 | Japan . |
| 3-114996 | 5/1991 | Japan . |

*Primary Examiner*—Jesus D. Sotelo

*Attorney, Agent, or Firm*—Foley & Lardner

[57] ABSTRACT

Adjustment is made of the position of a marine transportation system including a boat having a drive, a trimmable port tab and a trimmable starboard tab. The operation of the marine transportation system is monitored to provide an output distinguishing boat operation in an on-plane condition and boat operation in an off-plane condition, to provide an output distinguishing boat travel in a straight forward condition and boat travel in a turning condition and to provide an output distinguishing boat operation in a first heel condition in which the boat tilts to port and boat operation in a second heel condition in which the boat tilts to starboard. The port and starboard tabs are positioned at desired positions in response to the outputs. According to the embodiment, a heel adjustment operation of the boat is carried out during boat operation in an on-plane straight forward travel condition, only.

27 Claims, 17 Drawing Sheets

| OUTPUT OF BLOCK 300 | OUTPUT OF BLOCK 302 | OUTPUT OF BLOCK 304 |
|---|---|---|
| FIRST OUTPUT | FIRST OUTPUT | FIRST CODE |
| | SECOND OUTPUT | FIRST CODE |
| SECOND OUTPUT | FIRST OUTPUT | SECOND CODE |
| | SECOND OUTPUT | SECOND CODE |
| THIRD OUTPUT | FIRST OUTPUT | THIRD CODE |
| | SECOND OUTPUT | FIRST CODE |

AUTOMATIC CONTROL FOR TRIM TABS

BACKGROUND OF THE INVENTION

The present invention relates to an automatic control for trimmable port and starboard tabs of a boat.

In marine transportation systems such as boats with a stern drive and trimmable port and starboard tabs, hydraulic cylinder arrangements have been used to trim the port and starboard tabs. Automatic controls of such trimmable tabs have been disclosed in JP-A 3-82697 and JP-A 3-114996.

According to JP-A 3-82697, a torque sensor responds to a manipulation of a steeing wheel to sense the amount of effort to turn the steering wheel and a speed sensor senses the engine speed to operate a controller to automatically position port and starboard tabs.

According to JP-A 114996, a sensor responds to the operation of a boat to sense a pitch angle of the boat and another sensor responds to the operation of the boat to sense a roll angle of the boat to operate a controller to automatically position port and starboard tabs.

An object of the present invention is to provide an alternative to such automatic controls.

SUMMARY OF THE INVENTION

According to one aspect of the present invention, there is provided an apparatus to adjust the position of a marine transportation system including a boat having a drive, a trimmable port tab and a trimmable starboard tab, the apparatus comprising:

first sensing means for monitoring the operation of the marine transportation system to provide an output distinguishing boat operation in an on-plane condition and boat operation in an off-plane condition;

second sensing means for monitoring the operation of the marine transportation system to provide an output distinguishing boat travel in a straight forward condition and boat travel in a turning condition;

third sensing means for monitoring the operation of the marine transportation system to provide an output distinguishing boat operation in a first heel condition in which the boat tilts to port and boat operation in a second heel condition in which the boat tilts to starboard; and tab trimming means operable by said first, second and third sensing means to position the port tab at a desired position and the starboard tab at a desired position in response to said outputs of said first, second and third sensing means.

According to another aspect of the invention, there is provided an apparatus to adjust the position of a marine transportation system including a boat having a drive, a trimmable port tab and a trimmable starboard tab, the apparatus comprising:

controller means operable to generate an output signal in response to varying boat operating condition;

tab trimming means operable in response to said output signal of said controller means to position the port and starboard tab, means for generating a boat speed signal indicative of boat speed;

means for generating a rolling angle signal indicative of a roll angle through which the boat tilts during rolling;

means for generating a yaw angle signal indicative of a yaw angle through which the boat turns during yawing; and means for generating tab position signals indicative of positions of the port and starboard tabs, said controller means being operable in response to said boat speed signal and yaw angle signal to distinguish one boat operating condition from another and operable in response to said roll angle signal and said tab position signals to generate said output signal.

According to another aspect of the invention there is provided, a method of adjusting the position of a marine transportation system including a boat having a drive, a trimmable port tab and a trimmable starboard tab, the method comprising the steps of:

monitoring the operation of the marine transportation system to provide an output distinguishing boat operation in an on-plane condition and boat operation in an off-plane condition;

monitoring the operation of the marine transportation system to provide an output distinguishing boat travel in a straight forward condition and boat travel in a turning condition;

monitoring the operation of the marine transportation system to provide an output distinguishing boat operation in a first heel condition in which the boat tilts to port and boat operation in a second heel condition in which the boat tilts to starboard; and positioning the port tab at a desired position and the starboard tab at a desired position in response to said outputs.

BRIEF DESCRIPTION OF THE DRAWINGS

FIG. 16 is a side elevational view of an operating boat in water and illustrates a low speed operation in an off-plane condition with the port and starboard tabs downed to the maximum lowered position and trimmed-in;

DETAILED DESCRIPTION OF THE INVENTION

Figure 1:
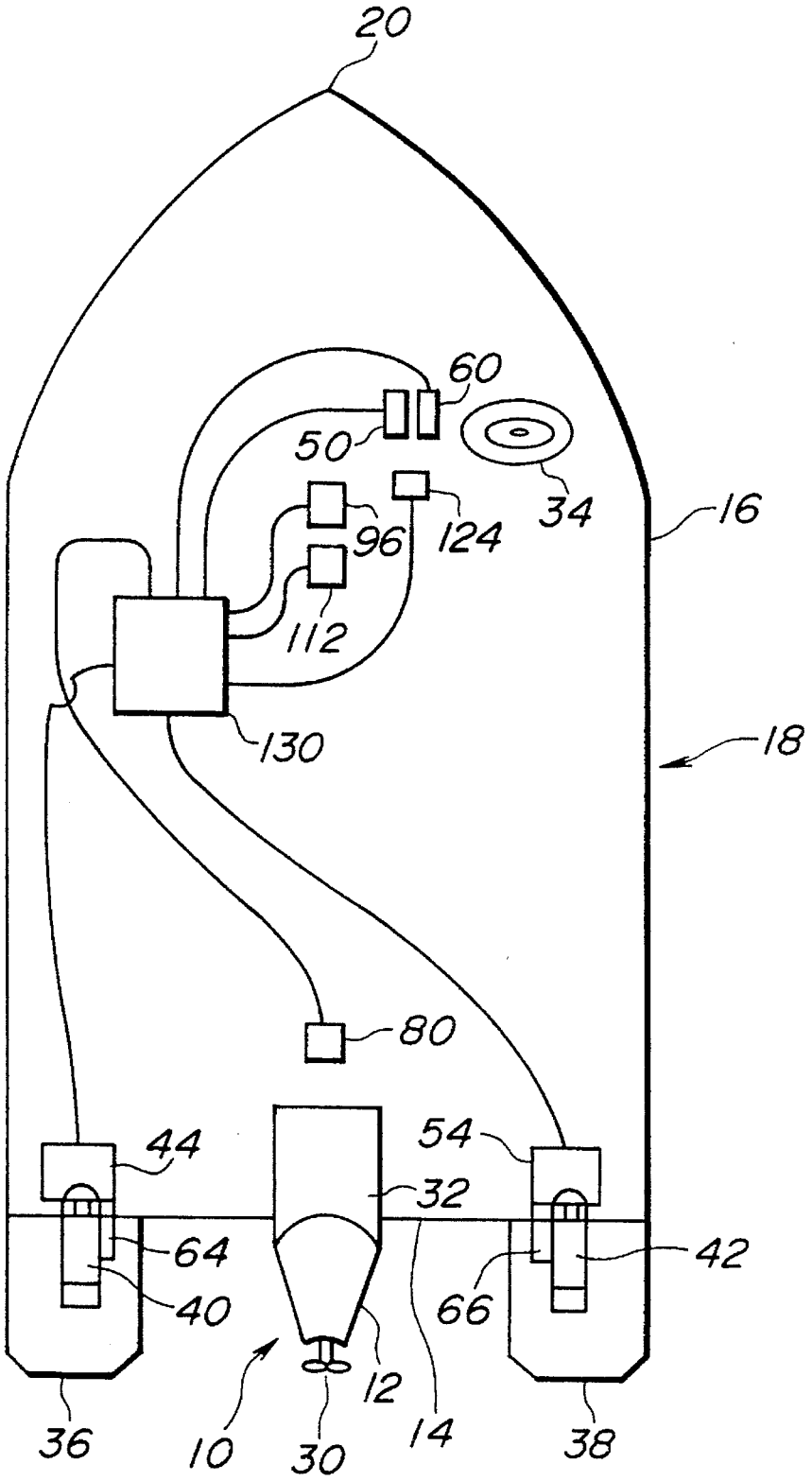
FIG. 1 is a schematic representation of a boat having a marine drive unit, a trimmable port tab and a trimmable starboard tab.
Figure 2:
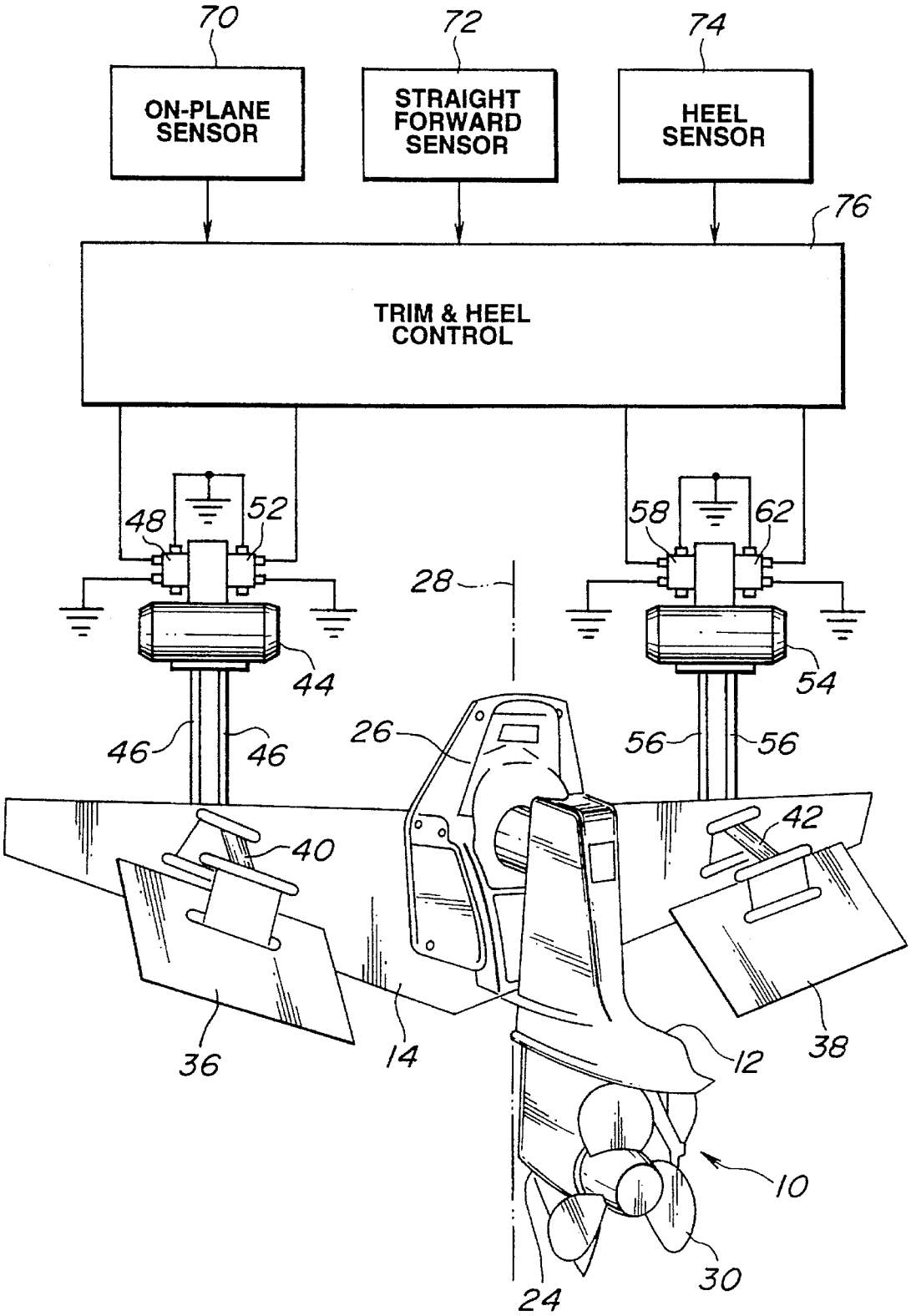
FIG. 2 is an illustration showing a perspective view of the drive unit and the port and starboard tabs mounted on the boat transom and an electrical trim and heel control shown in block diagram.

Referring to the drawings and particularly to FIG. 1, a marine drive 10 includes a stern drive unit 12 mounted on a rearwardly located transom 14 of a hull 16 of a boat 18. The hull 16 includes, in addition to the transom 14, a bow 20 and a keel 22 (see FIG. 4). The stern drive 12 is pivotally supported by a mounting assembly 26 (see FIG. 2) for rotation about a generally vertical axis 28 for steering the boat 18.

The stern drive unit 12 includes a propeller 30 driven by an engine 32 which is mounted either internally or externally of the hull 16 and connected through an appropriate drive.

The stern drive unit 12 is connected to a steering wheel 34 through an appropriate steering gear ioncluding a wire (not shown).

Trimmable port and starboard tabs 36 and 38 are connected to the transom 14. These tabs 36 and 38 are designed to pivot. To put the bow 20 down, both port and starboard tabs 36 and 38 are moved down to the maximum lower position, namely "trimmed-in" position. For low power or trailing operation, the port and starboard tabs 36 and 38 are lifted to the maximum raised position, namely "trimmed-out" position or zero degree position.

The boat 18 is provided with port and starboard hydraulic cylinders 40 and 42. The port hydraulic cylinder 40 operates to rotate the port tab 36 to the trimmed-out or zero degree position and the trimmed-in position and to maintain the tab 36 in any desired position. Similarly, the starboard hydraulic cylinder 42 operates to rotate the starboard tab 38 to the trimmed-out or zero degree position and the trimmed-in position and to maintain the tab 38 in any desired position. With varying boat constructions, the angular spacing between the trimmed-out and trimmed-in positions varies. In addition, the port and starboard tabs 36 and 38 may be operated manually by disengagement of the auto-control.

A port reversible electrohydraulic motor or pump 44 is connected to supply operating fluid to and from the port hydraulic cylinder 40 through a pair of hoses 46. An electrical out-trim or up relay 48 operates the electrohydraulic motor 44 for moving or lifting the port tab 36 from the trimmed-in position to the trimmed-out position or any position during manual operation via a port tab manual switch 50. An electrical in-trim or down relay 52 operates the electrohydraulic motor 44 for moving down the port tab 36 from the trimmed-out position to the trimmed-in position or any position during manual operation via the port tab manual switch 50. Similarly, a starboard reversible electrohydraulic motor or pump 54 is connected to supply operating fluid to and from the starboard hydraulic cylinder 42 through a pair of hoses 56. An electrical out-trim or up relay 58 operates the electrohydraulic motor 54 for moving or lifting the starboard tab 38 from the trimmed-in position to the trimmed-out position or any position during manual operation via a starboard tab manual switch 60. An electrical in-trim or down relay 62 operates the electrohydraulic motor 54 for moving down the starboard tab 38 from the trimmed-out position to the trimmed-in position or any position during manual operation via the starboard tab manual switch 60.

Preferably, a port tab angular position sensor 64 is mounted adjacent the port tab 36 and operable to provide an electrical signal which is responsive to the angular position of the port tab 36. Similarly to the position sensor 64, a starboard tab angular position sensor 66 is mounted adjacent the starboard tab 38 and operable to provide an electrical signal which is responsive to the angular position of the starboard tab 38.

Figure 3:
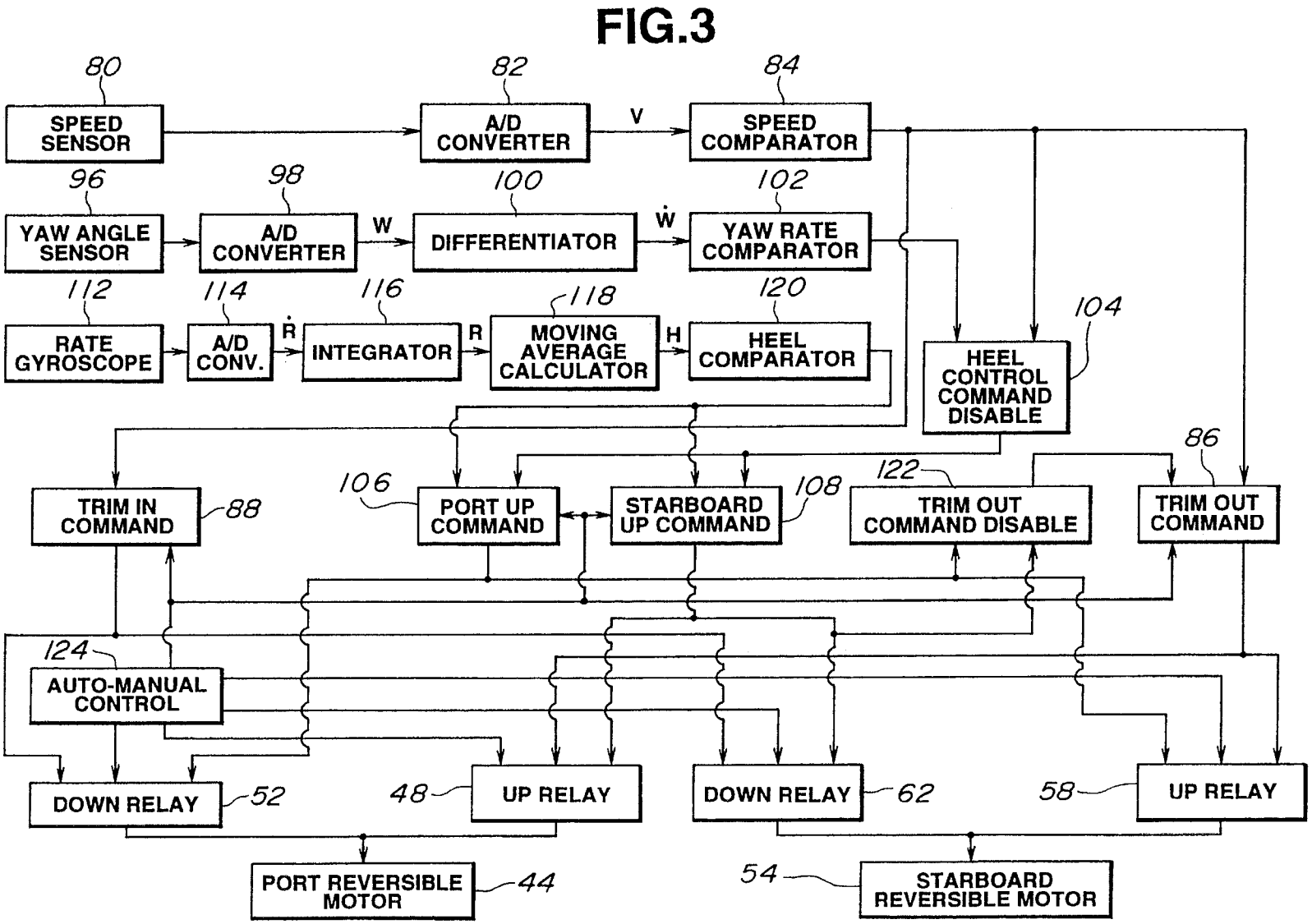
FIG. 3 is a block diagram of the trim and heel control of FIG. 2.
Figure 4:
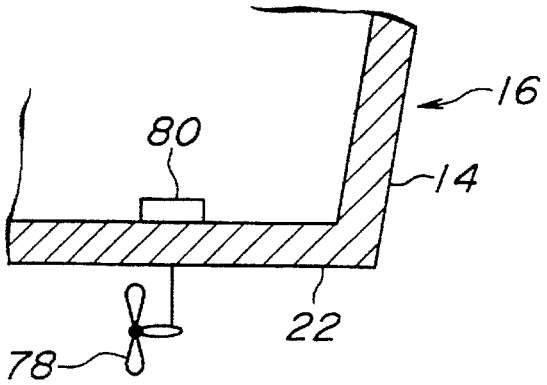
FIG. 4 is a schematic illustration of a propeller mounted on the boat keel for speed sending.

Referring to FIGS. 3 and 4, a propeller 78 is rotatably connected to the keel 22 and submerged. The propeller 78 is designed to increase its speed as the boat 18 increases its operating speed. A speed sensor 80 is coupled with the propeller 78 to provide a signal indicative of the operating speed of the boat 18, namely boat speed, which is supplied to an A/D converter 82. A speed comparator 84 receives a boat speed responsive signal V from the A/D converter 82 and provides a first output when the boat 18 operates at a very low speed below a first predetermined speed V1, a second output when the boat 18 is accelerated to operate at a low speed not lower than the first predetermined speed V1, but not exceeding a second predetermined speed V2 (V2>V1), and provides a third output when the boat 18 is further accelerated and operates at a high speed exceeding the second predetermined speed V2.

In a customary operating sequence, both the port and starboard tabs 36 and 38 are maintained at the trimmed-out position while the boat 18 operates at a very low speed for low power or trailing operation, and the port and starboard tabs 36 and 38 are maintained at the trimmed in position while the boat operates at a low speed not lower than the first predetermined speed V1 but not exceeding the second predetermined speed V2. When the boat 18 is accelerated to operate at a speed which is equal to or exceeding the first predetermined speed V1, the speed comparator 84 transfers from the first output to the second output in response to the signal sensed at the speed sensor 80. When the boat 18 is further accelerated to operate at a speed exceeding the second predetermined speed V2, the speed comparator 84 transfers from the second output to the third output in response to the signal sensed at the speed sensor 80.

A trim out command circuit 86 responds to the first output of the speed comparator 84 and provides a trim out command signal to the out trim or up relays 48 and 58.

The up relays 48 and 58 respond to the trim out command signal and operate the reversible electrohydraulic motors 44 and 54 to rotate to raise the port and starboard tabs 36 and 38 to upto the trimmed-out position.

A trim in command circuit 88 responds to the second output of the speed comparator 84 and provides a trim in command signal to the in trim or down relays 52 and 62.

The down relays 52 and 62 respond to the trim in command signal and operate the reversible electrohydraulic motors 44 and 54 to rotate to move the port and starboard tabs 36 and 38 from the trimmed-out position down to the trimmed-in position.

The trim out command circuit 86 responds to the third output of the speed comparator 84 unless command signals for heel adjustment are not provided. The up relays 48 and 58 respond to the trim out command signal and operate the reversible electrohydraulic motors 44 and 54 to rotate to raise the port and starboard tabs 36 and 38 upto the trimmed-out position for high speeds.

The second predetermined speed V2 is preselected according to the operating characteristic of the boat 18 so as to correspond to the transfer of the boat 18 from an off-plane condition to an on-plane condition. In other words, the second predetermined speed V2 is established at or shortly after the boat transfers from an off-plane to an on-plane condition. In similar manner the first predetermined speed V1 is preselected so as to correspond to the transfer of the boat 18 from a low power or trailing condition to a condition in which the bow 20 lifts. In other words, the first predetermined speed V1 is established at or shortly after the boat 18 transfers from a low power or trailing condition to a condition in which the bow 20 lifts. It is understood that such predetermined speeds will vary from boat to boat depending upon its mass, hull configuration, propeller thrust and many other factors which influence boat operation.

From the preceding, it is understood that the propeller 78, speed sensor 80, A/D converter 82 and speed comparator 84 constitute the on-plane sensor 70.

Figure 5:
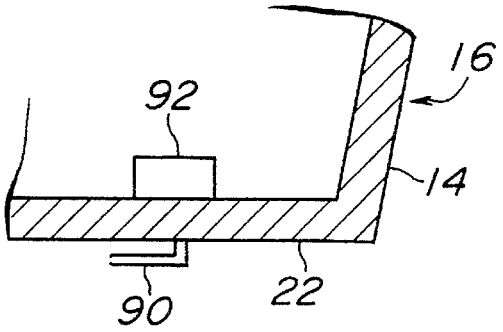
FIG. 5 is a schematic illustration of a pitot tube which may be mounted on the boat keel for speed sending in the place of the device of FIG. 4.
Figure 6:
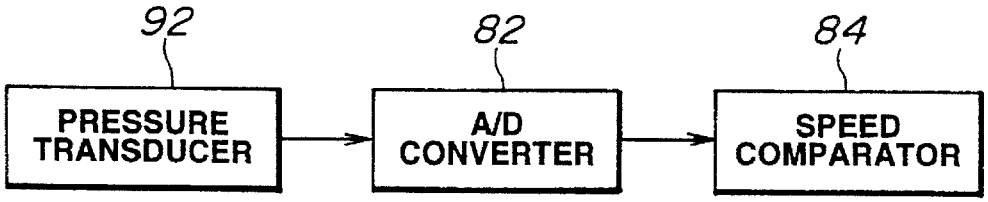
FIG. 6 is a block diagram of another form of an on-plane sensor of FIG. 3.

FIGS. 5 and 6 show an alternative form of on-plane sensor 70. A pitot tube 90 is connected to a keel 22 and submerged. A pressure transducer 92 is coupled with the pitot tube 90 to provide a signal indicative of the operating speed of the boat 18. This signal is supplied to an A/D converter 82. A speed comparator 84 receives a boat speed responsive signal V from the A/D converter 82 and provides a first output when the boat 18 operates at a very low speed below a first predetermined speed V1, a second output when the boat 18 is accelerated to operate at a low speed not lower than the first predetermined speed V1, but not exceeding a second predetermined speed V2 (V2>V1), and provides a third output when the boat 18 is further accelerated and operates at a high speed exceeding the second predetermined speed V2.

Figure 7:
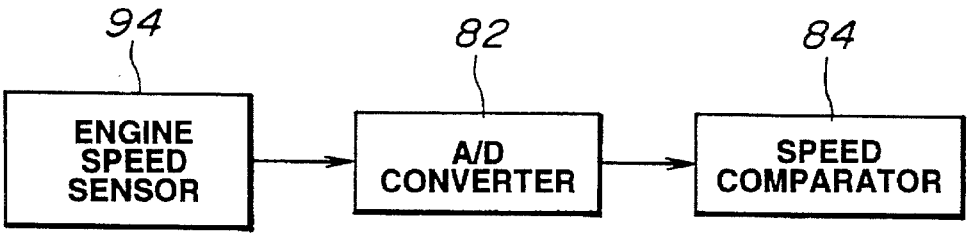
FIG. 7 is a block diagram of still another form of the on-plane sensor of FIG. 3.

FIG. 7 shows another alternative form of on-plane sensor 70. An engine speed sensor 94 is connected to the engine 32 which drives the propeller 30 of the stern drive unit 12. A signal indicative of the operating speed of the engine 32 is supplied from the engine speed sensor 94 to an A/D converter 82. A speed comparator 84 receives a speed responsive signal from the A/D converter 82 and provides a first output when the engine 32 operates at a very low speed below a first predetermined speed E1, a second output when the engine 32 operates at a low speed not lower than the first predetermined speed E1, but not exceeding a second predetermined speed E2 (E2>E1), and provides a third output when the engine 32 operates at a high speed exceeding the second predetermined speed E2. It is understood that the engine speed is usually indicative of the boat speed.

The second predetermined speed E2 is preselected according to the operating characteristic of the boat 18 so as to correspond to the transfer of the boat 18 from an off-plane condition to an on-plane condition, while the first predetermined speed E1 is preselected so as to correspond to the transfer of the boat 18 from a low power or trailing condition to a condition in which the bow 20 lifts.

Referring back to FIG. 3, the boat 18 has a yaw angle sensor 96 (see FIG. 1 also) which provides a signal indicative of a yaw angle, i.e., an angle through which the boat 18 yaws. This signal is supplied to an A/D converter 98. A differentiator 100 receives, as an input, a yaw angle responsive signal W from the A/D converter 98 and provides an output proportional to the derivative of the input with respect to time. Thus, the differentiator 100 provides, as the output, a yaw angle rate responsive signal $\dot{W}$ (W overdot). A yaw angle rate comparator 102 receives the yaw rate responsive signal to compare with a predetermined yaw angle rate value dWo and provides a first output when the yaw rate is less than the predetermined yaw rate and provides a second output when the yaw rate is equal to or exceeding the predetermined yaw rate.

The predetermined yaw rate dWo is selected according to the operating characteristic of the boat 18 so as to correspond to the transfer of the boat travel from a straight forward condition to a turning condition. In other words, the predetermined yaw rate dWo is established at or shortly after the boat 18 transfers from a straight forward condition to a turning condition. This predetermined yaw rate dWo is adjustable.

A heel control command disable circuit 104 receives the outputs of the speed comparator 84 and the yaw rate comparator 102 and provides a disable signal to a port up command circuit 106 and a starboard up command circuit 108 unless the first output of the yaw rate comparator 102 is present in the presence of the third output of the speed comparator 84. The port up and starboard up command circuits 106 and 108 are disabled responsive to the disable signal. The heel control command disable 104 provides an enable signal to the port up and starboard up command circuits 106 and 108 while the first output of the yaw rate comparator 102 is present in the presence of the third output of the speed comparator 84. In other words, the port up and starboard up commands 106 and 108 for the heel adjustment are enabled only when the boat travels in a straight forward condition and in an on-plane condition.

It is understood that the yaw angle sensor 96, A/D converter 98, differentiator 100 and yaw rate comparator 102 constitutes the straight forward sensor 72.

Figure 8:
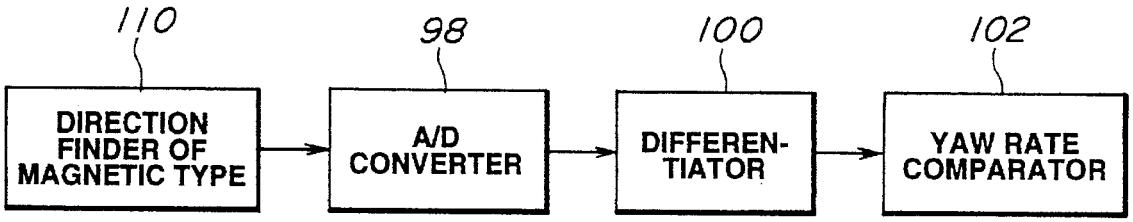
FIG. 8 is a block diagram of another form of a straight forward sensor of FIG. 3.

FIG. 8 shows an alternative form of straight forward sensor 72. A direction finder of the magnetic type 110 is mounted on the boat 18 to provide a signal indicative of a yaw angle to an A/D converter 98. A differentiator 100 receives a yaw angle responsive signal W from the A/D converter 98 and provides an output proportional to the derivative of the input with respect to time. The differentiator 100 provides a yaw rate responsive signal $\dot{W}$ (W overdot). A yaw rate comparator 102 receives the yaw rate responsive signal to compare with a predetermined yaw rate value dWo and provides a first output when the yaw rate is less than the predetermined yaw rate and provides a second output when the yaw rate is equal to or exceeding the predetermined yaw rate.

With reference to FIG. 3, the boat 18 has a rate gyroscope 112 which is so located and constructed as to provide a signal indicative of an angular velocity with which the boat 18 moves during rolling. This signal is supplied to an A/D converter 114. An integrator 116 receives, as an input, an angular velocity responsive signal $\dot{R}$ (R overdot) from the A/D converter 114 and provides an output proportional to the integral of the input with respect to time. Thus, the integrator 116 provides, as the output, a roll angle responsive signal R to a moving average calculator 118. Moving average is expressed by the equation as follows:

$$Ravk = (1/N) \sum_{i=k-N}^{k} Ri \qquad \text{Eq. 1}$$

where, Ri: a roll angle at a previous moment i;

N: a number of sampled data;

Ravk: moving average at a moment k.

The moving average calculator 118 outputs the calculated result Ravk as a heel angle H and provides a heel angle responsive signal. A heel comparator 120 receives the heel angle responsive signal H from the moving average calculator 118 to compare with a target heel angle Ht. The heel comparator 120 provides a first output when the boat 18 operates in a first heel condition in which the boat 18 tilts to port and a second output when the boat 18 operates in a second heel condition in which the boat 18 tilts to starboard. Specifically, the heel comparator 120 provides the first output when the heel angle H is greater than or equal to the target heel angle Ht and the second output when the heel angle H is less than the target heel angle Ht.

The port up command 106 responds to the first output of the heel comparator 120 and the enable signal from the heel control command disable 104 and provides a port up command signal to the down relay 52 for the port reversible motor 44 and the up relay 58 for the starboard reversible motor 54.

The starboard up command 108 responds to the second output of the heel comparator 120 and the enable signal from the heel control command disable 104 and provides a starboard up command signal to the up relay 48 for the port reversible motor 44 and the down relay 62 for the starboard reversible motor 54.

Each of the port up command signal and the starboard up command signal also operates as a disable signal, through a trim out command disable circuit 122, to the trim out command 86 which, in turn maintains the up relays 48 and 56 deenergized.

The down relay 52 for the port reversible motor 44 and the up relay 58 for the starboard reversible motor 54 respond to the port up command signal and operate the port reversible motor 44 to rotate to move the port tab 36 down to a target angular position and the starboard reversible motor 54 to rotate to hold the starboard tab 38 at the trimmed-out position.

The up relay 48 for the port reversible motor 44 and the down relay 62 for the starboard reversible motor 54 respond to the starboard up command signal and operate the port reversible motor 44 to rotate to hold the port tab 36 at the trimmed-out position and the starboard reversible motor 54 to rotate to move the starboard tab 38 down to a target angular position.

The trim in operation, trim out operation and heel adjustment operation discussed above are conducted automatically when an auto-manual control 124 is conditioned for automatic operation. In response to the established automatic operation, an enable signal is supplied to the trim out command 86, trim in command 88, port up command 106 and starboard up command 108.

When the auto-manual control 124 is conditioned for manual operation, manipulation of the port tab manual switch 50 and the starboard tab manual switch 60 causes the port and starboard reversible motors 44 and 54 to move the port and starboard tabs 36 and 38 to any desired positions. The position sensors 64 and 66 are relied upon to determine whether the port and starboard tabs 36 and 38 have moved to the desired positions.

It is understood that the rate gyroscope 112, A/D converter 114, integrator 116, moving average calculator 118 and heel comparator 120 constitute the heel sensor 74.

Figure 9:
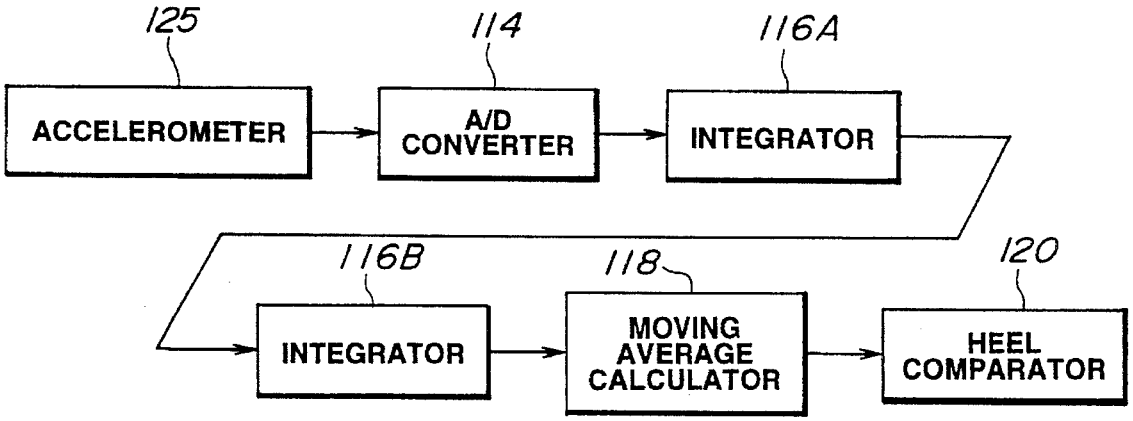
FIG. 9 is a block diagram of another form of a heel sensor of FIG. 3.

FIG. 9 shows an alternative form of heel sensor 74. An accelerometer 125 is so located on the boat 18 as to provide a signal indicative of an angular acceleration with which the boat 18 is subjected to during rolling. This signal is supplied to an A/D converter 114. The output of the A/D converter 114 is supplied to a first stage integrator 116A. The output of the first stage integrator 116A is supplied to a second stage integrator 116B to provide a roll angle indicative signal R to a moving average calculator 118. The output of the moving average calculator 118 is supplied to a heel comparator 120.

Figure 10:
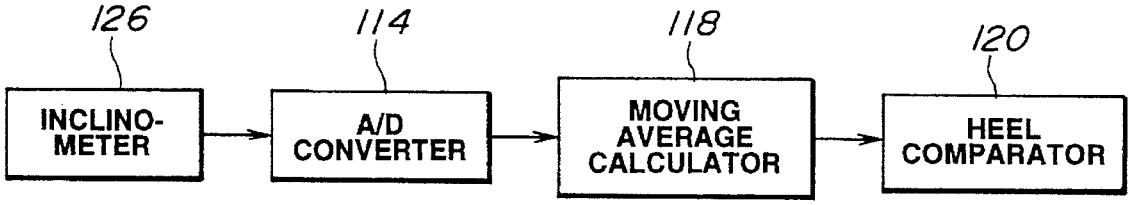
FIG. 10 is a block diagram of still another form of the heel sensor of FIG. 3.

FIG. 10 shows another alternative form of heel sensor 74. An inclinometer 126 is so located on the boat 18 and constructed as to provide a signal indicative of a roll angle to an A/D converter 114. A moving average calculator 118 receives a roll angle responsive signal R from the A/D converter 114 and provides a heel angle responsive signal H to a heel comparator 120. The heel comparator 120 provides a first output when the boat 18 operates in a first heel condition in which the boat 18 tilts to port and a second output when the boat 18 operates in a second heel condition in which the boat 18 tilts to starboard.

A preferred implementation of the present invention can be understood with reference to FIGS. 11 to 14.

Figure 11:
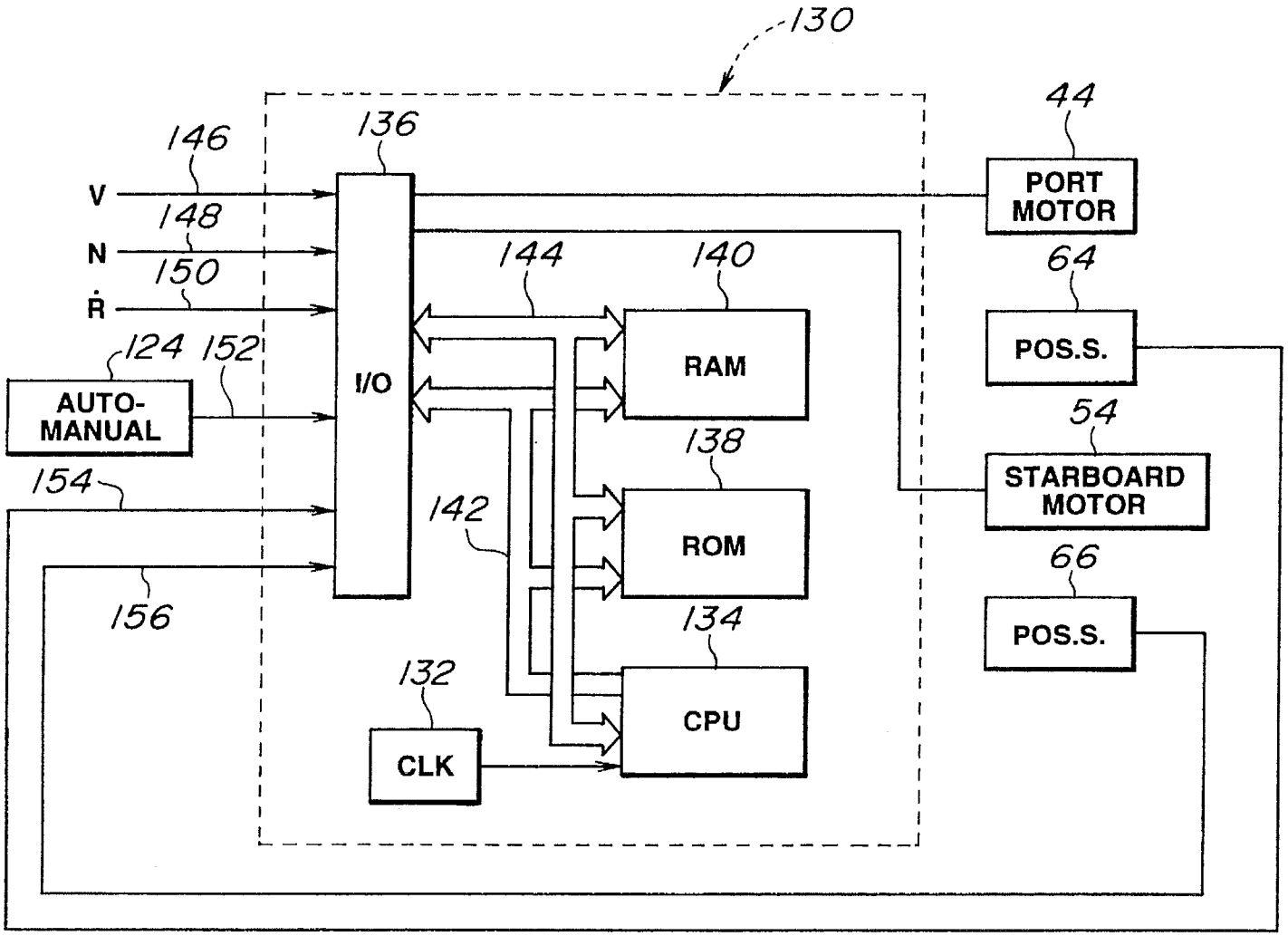
FIG. 11 is a block diagram of another form of the trim and heel control of FIG. 3.

Referring to FIG. 11, a control unit 130 includes a clock 132, a central processor unit (I/O) 136, a read only memory (ROM) 138 and a random access memory (RAM) 140. In the control unit 130, the clock 132 provides operational clock pulses to the CPU 134. The CPU 134 controls the I/O unit 136, the ROM 138 and the RAM 140 through control bus 142. Bi-directional data bus 144 provides for the transfer of the data between the I/O unit 136, the ROM 138, the RAM 140 and the CPU 134.

Line 146 carries a signal indicative of boat speed V, line 148 carries a signal indicative of yaw angle W and line 150 carries a signal indicative of angular velocity $\dot{R}$ (R overdot) during rolling. Line 152 carries a signal representing that an auto-manual control 124 is conditioned for automatic operation. Lines 154 and 156 carry signals indicative of angular positions of port and starboard tabs 36 and 38, respectively.

Figure 12:
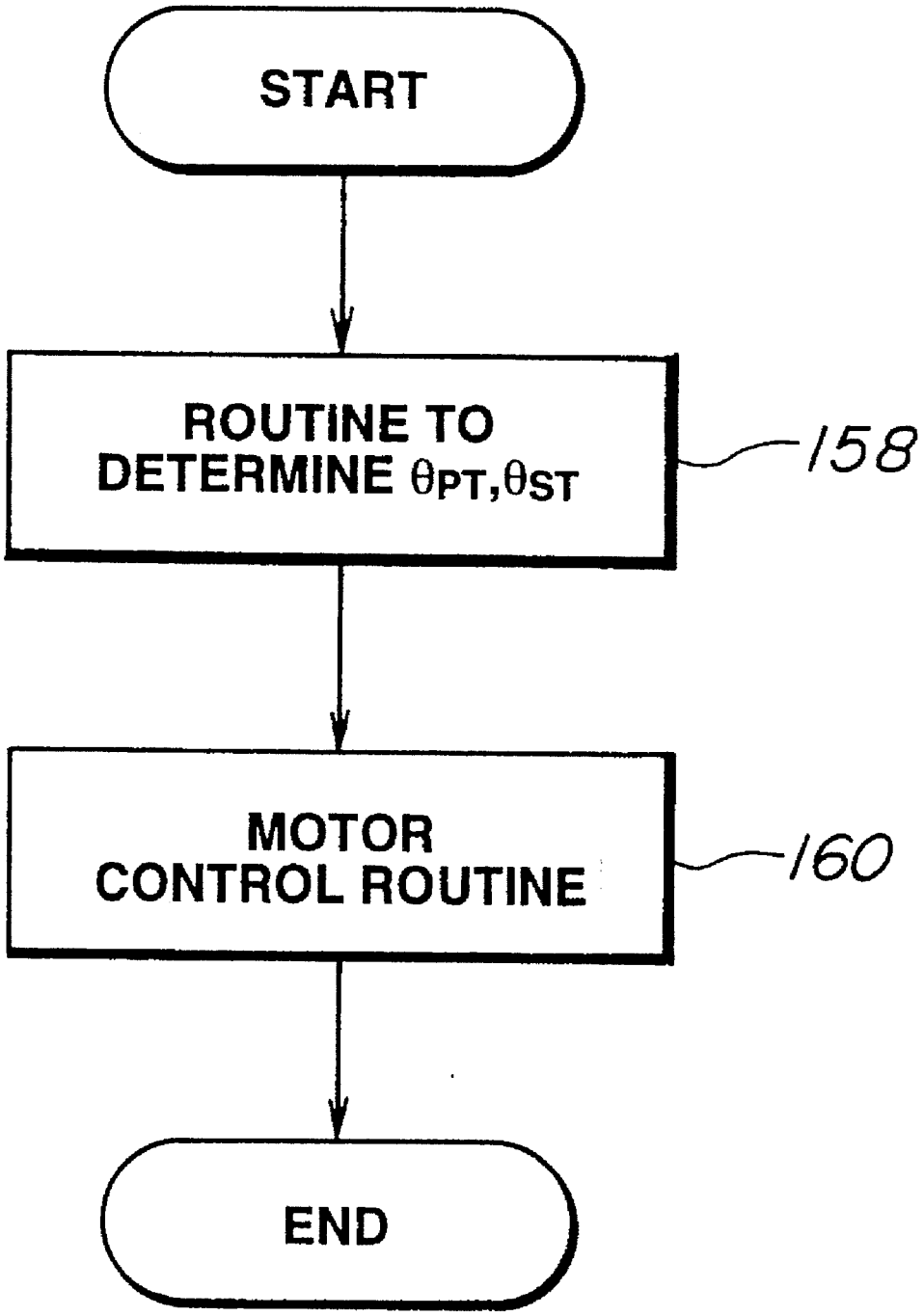
FIG. 12 is a simplified flow chart.
Figure 13:
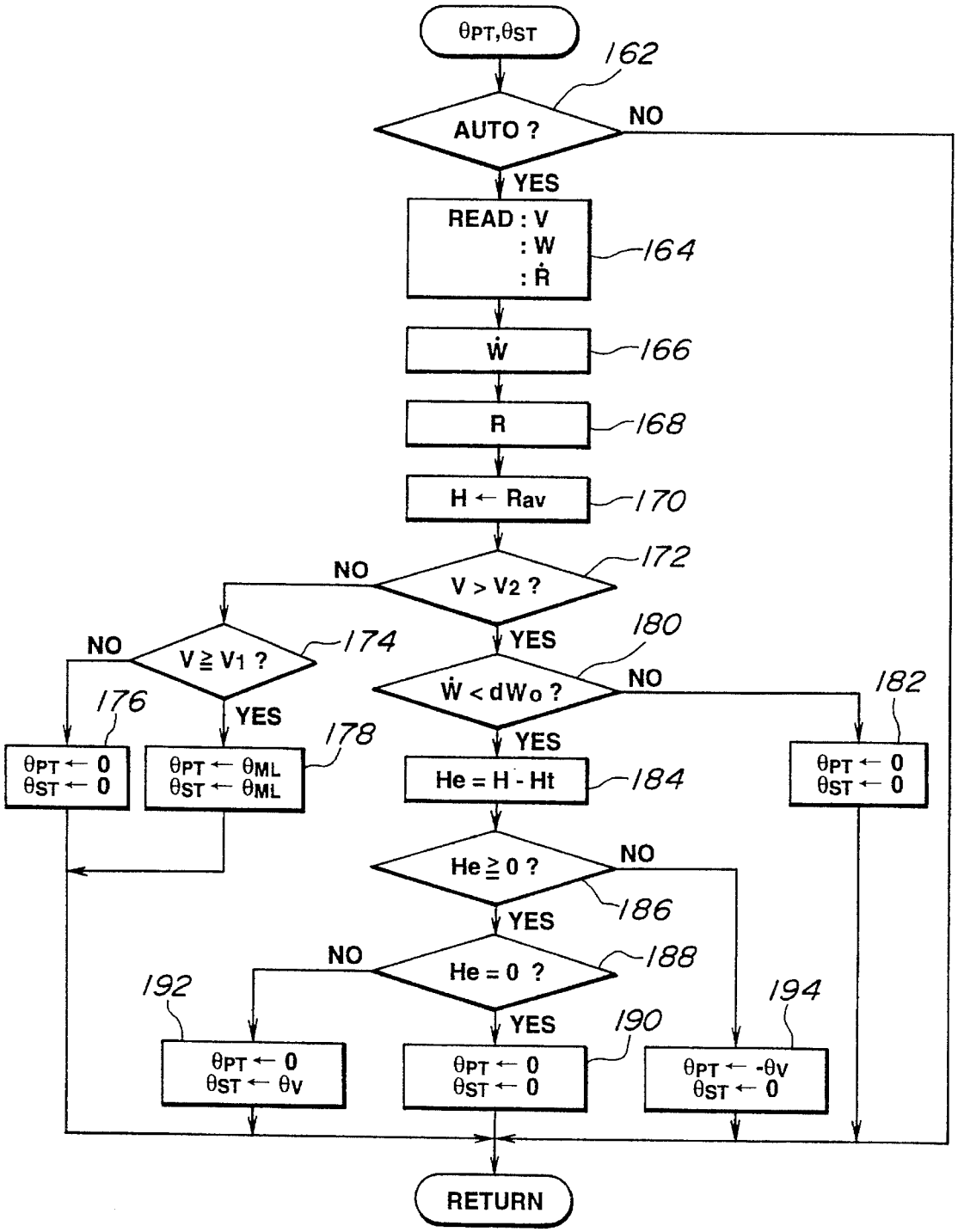
FIG. 13 is a simplified flow chart of a target tab position determining routine which can be programmed into the microcomputer of FIG. 11.
Figure 14:
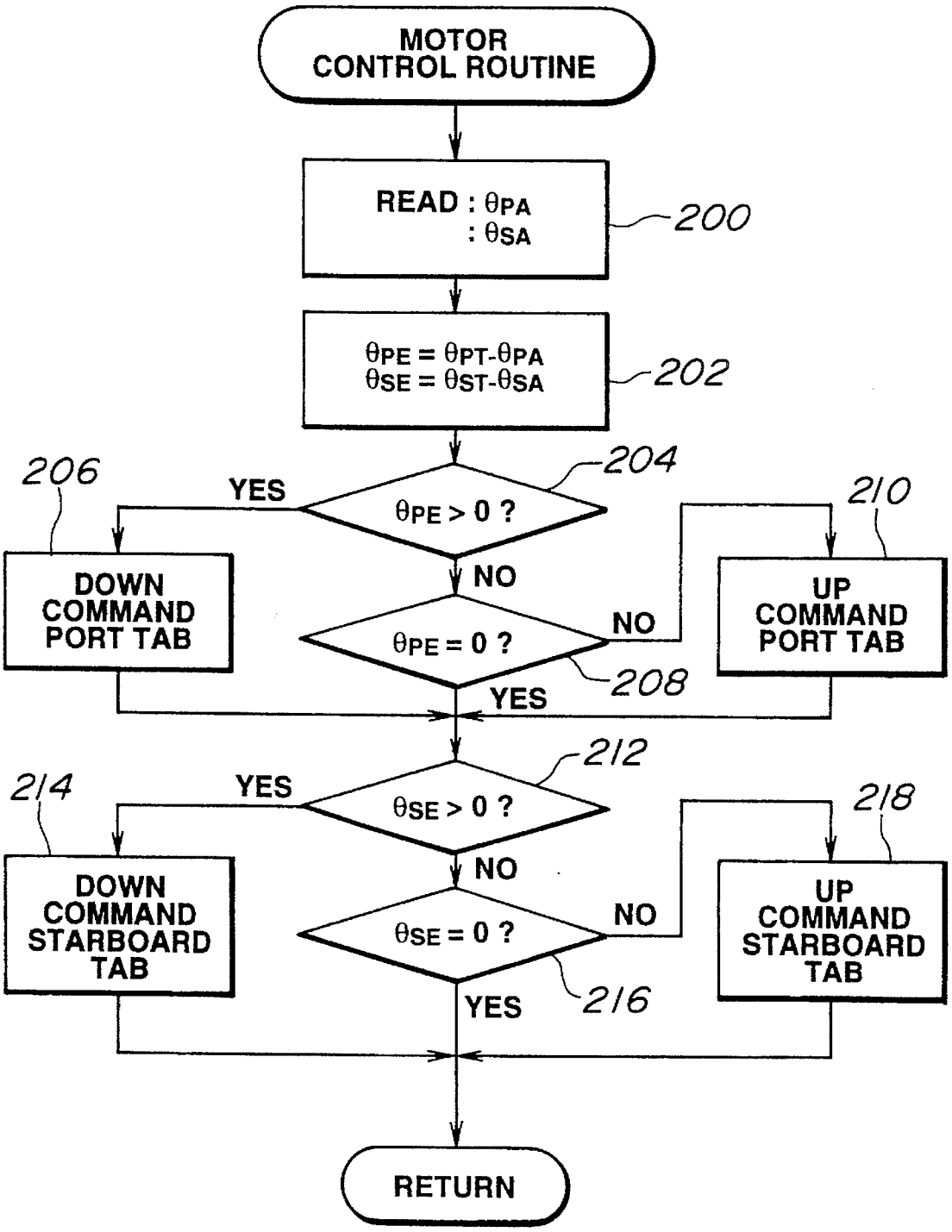
FIG. 14 is a simplified flow chart of a reversible electro-hydraulic motor control routine which can be programmed into the microcomputer of FIG. 11.

The flow diagram in FIG. 12 illustrates a control routine of the preferred implementation of the present invention. The flow diagrams in FIGS. 13 and 14 illustrate sub routines of the control routine. Execution of the control routine is repeated at regular intervals.

In FIG. 12, at a block 158, the sub routine in FIG. 13 is executed to determine port and starboard tab target angular positions $\theta_{PT}$ and $\theta_{ST}$. At a block 160, the motor control routine in FIG. 14 is executed.

At a decision block 162, the control unit 130 determines whether or not the auto-manual control 124 is conditioned for automatic operation. At an input block 164, the control unit 130 inputs information of: boat speed V, yaw angle W and angular velocity $\dot{R}$ (R overdot) in rolling.

At a block 166, the control unit 130 computes the differential of yaw angle R with respect to time to provide a yaw angle rate $\dot{W}$ (W overdot) by subtracting from the current yaw angle reading the previous yaw angle reading obtained during the adjacent previous run of the sub routine. At a block 168, the control unit 130 computes the integral of the angular velocity $\dot{R}$ (R overdot) with respect to time to provide a roll angle R. At a block 170, the control unit 130 computes the moving average of roll angle Rav to provide the result as a heel angle H.

The control unit 130 determines at a block 172 whether or not the current boat speed V is greater than a second predetermined speed V2.

If the current boat speed V is euqal to or less than the second predetermined speed V2, the control unit 130 determines, at a block 174, whether or not the current boat speed V is greater than or equal to a first predetermined speed V1 that is less than the second predetermined speed V2. If the current boat speed V is less than the first predetermined speed V1, the control unit 130 sets, at a block 176, port and starboard tab target positions $\theta_{PT}$ and $\theta_{ST}$ equal to zero degree which correspond to the trimmed-out position.

If, at the block 174, the current boat speed V is equal to or greater than the first predetermined speed V1, the control unit 130 sets, at a block 178, the port and starboard tab target positions $\theta_{PT}$ and $\theta_{ST}$ equal to $\theta_{ML}$ which corresponds to the trimmed-in position.

If, at the block 172, the current boat speed V is greater than the second predetermined speed V2, the control unit 130 determines, at a block 180, whether or not the current yaw angle rate $\dot{W}$ (W overdot) is less than a predetermined yaw angle rate dWo.

If the current yaw angle rate $\dot{W}$ (W overdot) is greater than or equal to the predetermined yaw angle rate dWo, the control unit 130 sets, at a block 182, the port and starboard tab target positions $\theta_{PT}$ and $\theta_{ST}$ equal to zero degree, i.e., the trimmed-out position.

If, at the block 180, the current yaw angle rate W (W overdot) is less than the predetermined yaw angle rate dWo, the control unit 130 computes, at a block 184, an error He by subtracting a target heel angle Ht from the current heel angle H.

The error He is evaluated at blocks 186 and 188. At the block 186, the control unit 130 determinesd whether or not the error He is greater than or equal to zero. If, at the block 186, the error He is greater than or equal to zero, the control unit 130 determines, at the block 188, whether or not the error He is equal to zero.

If, at the block 188, the error He is zero, the control unit 130 sets, at a block 190, the port and starboard tab target positions $\theta_{PT}$ and $\theta_{ST}$ equal to zero degree, i.e., the trimmed-out position.

If the boat 18 tilts to starboard and thus the error He is greater than zero, the control unit 130 sets, at a block 192, the port tab target position $\theta_{PT}$ equal to zero degree, i.e., the trimmed-out position, and the starboard tab target position $\theta_{ST}$ equal to a value $\theta_V$ which is expressed by the equation as follows:

$$\theta_V = K_p He + K_D \frac{d}{dt} He + K_I \int Hedt \qquad \text{Eq. 2}$$

where, $K_P$, $K_D$ and $K_I$ are constants.

If the boat 18 tilts to port and thus the error He is less than zero, the control unit 130 sets, at a block 194, the port tab target position $\theta_{PT}$ equal to $-\theta_V$, and the starboard tab target position $\theta_{ST}$ equal to zero degree, i.e., the trimmed-out position.

At an input block 200 in FIG. 14, the control unit 130 inputs information of: an actual angular position $\theta_{PA}$ of port tab 36 and an actual angular position $\theta_{ST}$ of starboard tab 38. The control unit 130 computes, at a block 202, an error $\theta_{PE}$ by subtracting $\theta_{PA}$ from $\theta_{PT}$ and an error $\theta_{SE}$ by subtracting $\theta_{SA}$ from $\theta_{ST}$.

At a decision block 204, the control unit 130 determines whether or not the error $\theta_{PE}$ is greater than zero. If the error $\theta_{PE}$ is greater than zero, the control unit 130 provides, at a block 206, a down command to the port reversible motor 44. If, at the decision block 204, the error $\theta_{PE}$ is not greater than zero, the control unit 130 determines, at a block 208, whether or not the error $\theta_{PE}$ is zero. If the error $\theta_{PE}$ is less than zero, the control unit 130 provides, at a block 210, an up command to the port reversible motor 44. If the error $\theta_{PE}$ is zero, the control unit 130 proceeds to a decision block 212.

After the block 206 or block 210 or block 208, the control unit 130 determines, at block 212, whether the error $\theta_{SE}$ is greater than zero. If the error $\theta_{SE}$ is greater than zero, the control unit 130 provides, at a block 214, a down command to the starboard reversible motor 54. If, at the decision block 212, the error $\theta_{SE}$ is not greater than zero, the control unit 130 determines, at a decision block 216, whether or not the error $\theta_{SE}$ is zero. If the error $\theta_{SE}$ is less than zero, the control unit 130 provides, at a block 218, an up command to the starboard reversible motor 54. If the error $\theta_{SE}$ is zero, the control unit 130 comes to an end of the motor control routine.

Figure 15:
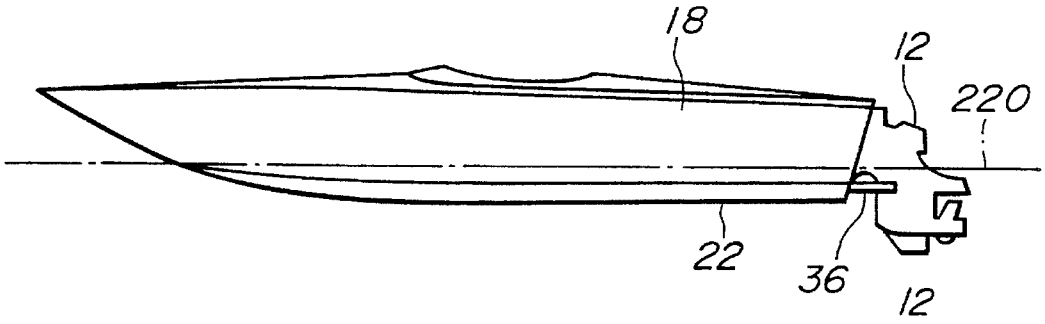
FIG. 15 is a side elevational view of an operating boat in water and illustrates a low power or trailing operation.
Figure 16:
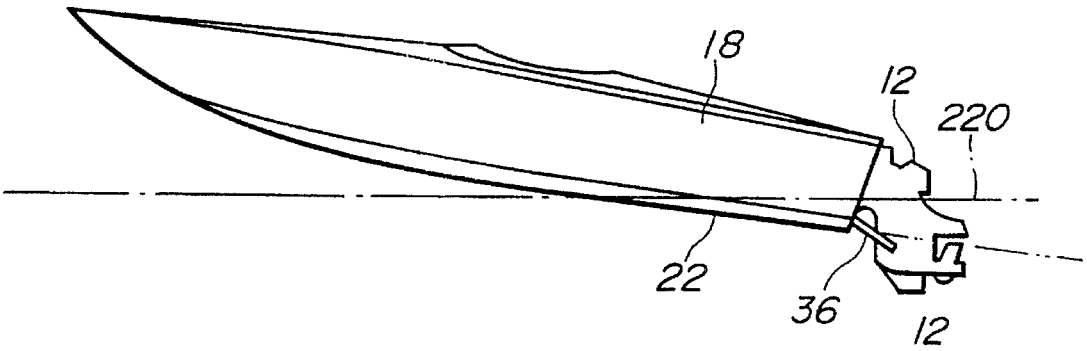
Figure 17:
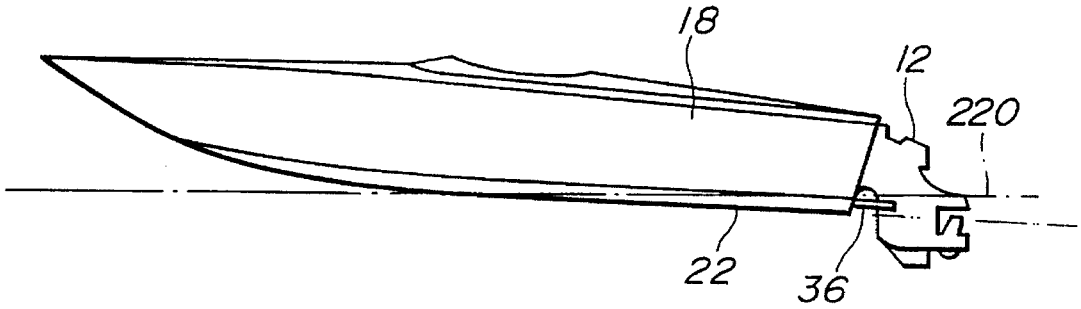
FIG. 17 is a side elevational view of an operating boat in water and illustrates a high speed straight forward travel operation in an on-plane condition with the port and starboard tabs lifted to the maximum raised position and trimmed-out.

FIGS. 15, 16 and 17 represent various operating conditions of the boat 18 and illustrate the boat angle of attack measured by the relationship of the keel 22 to the average water surface illustrated at 220. In FIG. 15, the port and starboard tabs 36 and 38 are at the trimmed-out positions and the boat 18 is operating at a very low speed below Vl for low power or trailing operation. In FIG. 16, the port and starboard tabs 36 and 38 are at the trimmed-in positions and the boat 18 is operate at a low speed between Vl and V2 with its bow 20 lifted. In other words, the boat 18 is operating in an off-plane condition. FIG. 17, the port and starboard tabs 36 and 38 are at the trimmed-out positions and the boat 18 is operating at a high speed exceeding V2 in an on-plane and straight forward travel condition.

With the system constructed to operate in accordance with the embodiment, the heel adjustment control is enabled during boat operation in an on-plane straight forward travel condition in response to the moving average of varying roll angle readings. This is advantageous in minimizing or at least reducing the magnitude of load which the port and starboard reversible motors 44 and 54 are subjected to.

Figure 18:
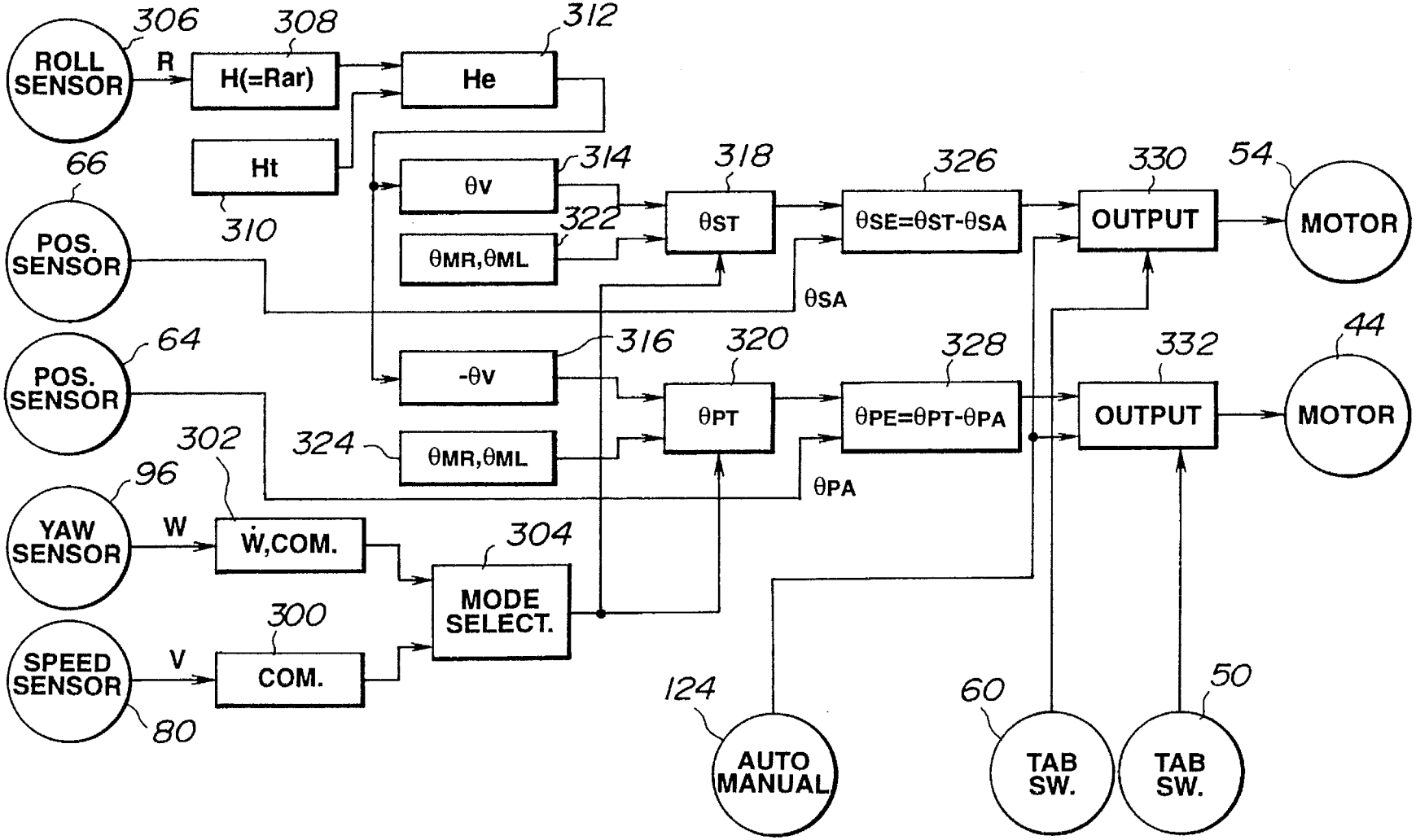
FIG. 18 is a functional diagram implementing the invention.
Figures 19, 20:
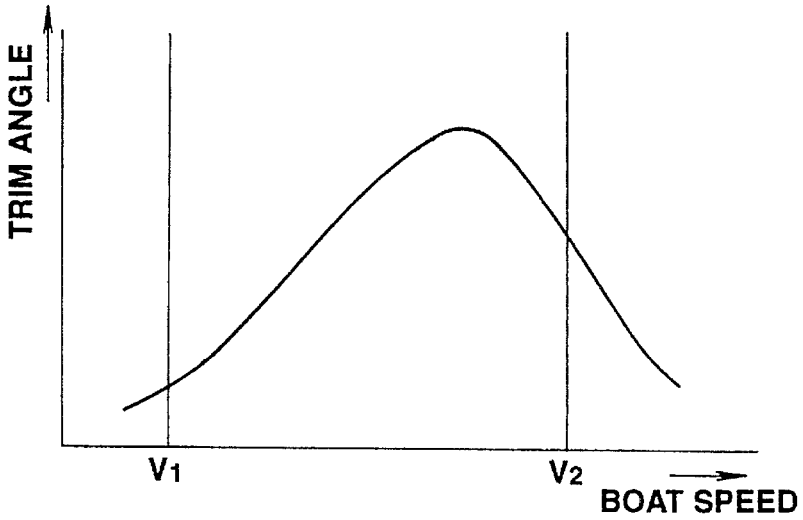
FIG. 19 is a graphical representation of the characteristic of a boat.
FIG. 20 is a table.

Referring to FIGS. 18 to 20, another form of a trim and heel control strategy is explained.

FIG. 18 is functional diagram. At a block 300, a signal indicative of boat speed V derived from a speed sensor 80 is compared with a first predetermined speed V1 and a second predetermined speed V2. The first predetermined speed V1 is lower than the second predetermined speed V2. FIG. 19 illustrates a trim angle versus boat speed characteristic. The speed comparison block 300 provides a first output when the boat speed V is less than the first predetermined speed V1, a second output when the boat speed V falls in a window defined by the first and second predetermined speeds V1 and V2 or equal to them, and a third output when the boat speed V is greater than the second predetermined speed V2.

At a block 302, a signal indicative of yaw angle W is a differentiated with respect to time to provide a yaw angle rate $\dot{W}$ ( W overdot) for comparison with a predetermined yaw angle rate dWo. The differentiation & comparison block 302 provides a first output when the yaw angle rate $\dot{W}$ (W overddot) is less than the predetermined yaw rate dWo, and a second output when the yaw angle rate $\dot{W}$ (W overdot) is equal to or exeed the predetermined yaw angle rate dWo.

Based on the outputs of the blocks 300 and 302, an appropriate one of control modes is selected at a block 304. The control mode selection block 304 provides a first code when the speed comparison block 304 provides the first output thereof. This block 304 provides the first code when the differentiation & yaw rate comparison block 302 provides the second output thereof with the speed comparison block 300 providing the third output thereof. The control mode selection block 304 provides a second code when the speed comparison block 300 provides the second output thereof. The control mode selection block 304 provides a third code when the differentiation & yaw rate comparison block 302 provides the first output thereof with the speed comparison block 300 providing the third output thereof. The relationship is tabulated in FIG. 20.

A roll angle sensor 306 provides a signal indicative of roll angle R through which a boat 18 moves during rolling. The roll angle sensor 306 includes an accelerometer of the type TA25 manufactured by Tokimec Co., Ltd., located in Tokyo Japan, and an integrator. At a block 308, a moving average Rav (see Eq. 1) of preceding roll angle readings is calculated. The average calculation block 308 provides the calculated moving average Rav as a heel angle H.

A block 310 provides a target heel angle Ht. The target heel angle Ht and the actual heel angle H are supplied to a block 312. At the block 312, an error He is calculated by subtracting Ht from H, i.e., He=H–Ht. The error He is supplied to a block 314 and also to a block 316.

At the block 314, it is determined whether the error He is greater than or equal to 0 (zero) or not. If the error He is greater than or equal to zero, i.e., the boat 18 tilts to starboard, a value $\theta_V$ is calculated and stored as a candidate for a target position of a starboard tab 38. If the error He is less than 0 (zero), i.e., the boat 18 tilts to port, the value $\theta_V$ is set equal to 0 (zero) and stored as the candidate for the target position of starboard tab 38.

At the block 316, it is determined whether the error He is greater than or equal to 0 (zero) or not. If the error He is greater than or equal to zero, i.e., the boat 18 tilts to starboard, the value $\theta_V$ is set equal to 0 (zero) and stored as a candidate for a target position of a port tab 36. If the error is less than 0 (zero), i.e., the boat 18 tilts to port, a value $-\theta_V$ is calculated and stored as the candidate for the target position of port tab 36.

The value $\theta_V$ is calculated by the equation 2 which has been explained in connection with the flow chart of FIG. 13.

The output $\theta_V$ of the block 314 is supplied to a starboard tab target position selection block 318, while the output $-\theta_V$ of the block 320 is supplied to a port tab target position selection block 320.

Supplied also to the block 318 is an output of a block 322. At the block 322, two other candidates for the target position of starboard tab 38 are generated. The two other candidates include a value $M_R$ representing a maximum raised starboard tab position and a value $M_L$ representing a maximum lowered starboard tab position.

Supplied also to the block 320 is an output of a block 324. At the block 324, two other candidates for the target position of port tab 36 are generated. The two other candidates include a value $M_R$ representing a maximum raised port tab position and a value $M_L$ representing a maximum lowered port tab position.

The block 318 is supplied with the output of the control mode selection block 304 and selects among the candidates $M_R$, $M_L$ and $\theta_V$ an appropriate one as a starboard tab target position $\theta_{ST}$. Particularly, if the first code is stored, the starboard tab target position $\theta_{ST}$ is set equal to $M_R$. If the second code is stored, the starboard tab target position $\theta_{ST}$ is set equal to $M_L$. If the third code is stored, the starboard tab target position $\theta_{ST}$ is set equal to $\theta_V$.

Similarly, the block 320 is supplied with the output of control mode selection block 304 and selects among the candidates $M_R$, $M_L$ and $-\theta_V$ an appropriate one as a port tab target position $\theta_{PT}$. Particularly, if the first code is stored, the starboard tab target position $\theta_{PT}$ is set equal to $M_R$. If the second code is stored, the starboard tab target position $\theta_{PT}$ is set equal to $M_L$. If the third code is stored, the starboard tab target position $\theta_{PT}$ is set equal to $-\theta_V$.

The tab target positions $\theta_{ST}$ and $\theta_{PT}$ are supplied to blocks 326 and 328, respectively. An actual starboard tab position $\theta_{SA}$ is supplied to the block 326. An actual port tab position $\theta_{PA}$ is supplied to the block 328.

At the block 326, an error $\theta_{SE}$ is calculated by subtracting $\theta_{SA}$ from $\theta_{ST}$. At the block 328, an error $\theta_{PE}$ is calculated by subtracting $\theta_{PA}$ from $\theta_{PT}$. These errors $\theta_{SE}$ and $\theta_{PE}$ are supplied to output units 330 and 332, respectively. The output unit 330 provides a down signal to a starboard motor 54 if the error $\theta_{SE}$ is positive, while it provides an up signal to the starboard motor 54 if the error $\theta_{SE}$ is negative. The output unit 332 provides a down signal to a port motor 44 if the error $\theta_{PE}$ is positive, while it provides an up signal to the port motor 44 if the error $\theta_{PE}$ is negative.

The above discussed operation is conducted automatically when an auto-manual control switch 124 is conditioned for automatic operation. When the auto-manual switch 124 is conditioned for manual operation, manipulation of port and starboard tab manual switches 50 and 60 causes the output units 330 and 332 to provide up or down signal to the port and starboard motors 44 and 54.

A preferred implementation of the control strategy discussed above in connection mainly with FIG. 18 can be understood with reference to flow charts of FIGS. 21 to 25.

Figure 21:
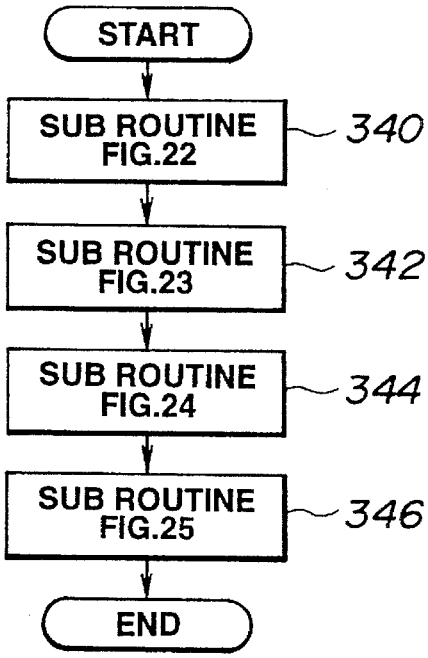
FIG. 21 is a flow chart of a main routine implementing the invention.

The flow chart of FIG. 21 illustrates a main control routine of the preferred implementation. The flow chart of FIGS. 22 to 25 illustrate sub routines.

Figure 22:
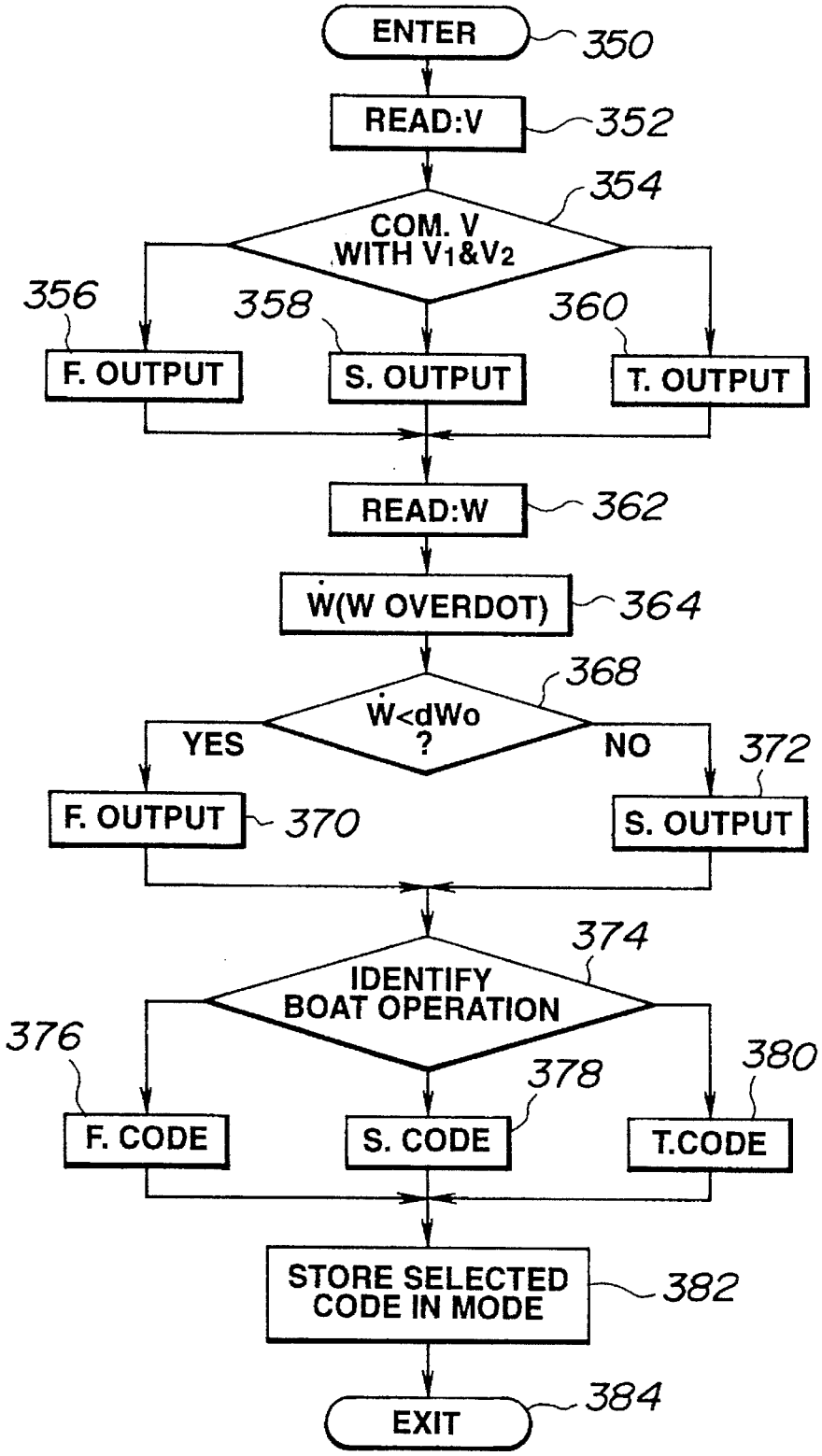

In FIG. 21, at a block 340, selection of control mode is made by executing the sub routine of FIG. 22. What is done at this block 340 corresponds to what is done at the blocks 300, 302 and 304 of FIG. 18. The logic flow goes to a block 342 where calculation of tab position is carried out by executing the sub routine of FIG. 23. What is done at this block 342 corresponds to what is done at the blocks 308, 310, 312, 314 and 316 of FIG. 18. Then, the logic flow goes to a block 344 where selection of target position is carried out by executing the sub routine of FIG. 24. What is done at this block 344 corresponds to what is done at the blocks 318 and 320 of FIG. 18. Finally, the logic flow goes to a block 346 where calculation of an error and zero control are carried out by executing a sub routine of FIG. 25.

The sub routine of FIG. 22 begins at an enter block 350. Logic flow goes to a block 352 where reading operation is performed to store a boat speed V. Logic flow goes to a decision block 354 where the stored boat speed V is compared with first and second predetermined speeds V1 and V2 (V1 being less than V2). If the boat speed V is less than V1, logic flow goes to a block 356 where a first signal is stored in a memory location M(S). If the boat speed V falls in a window defined by V1 and V2 or is equal to V1 or V2, logic flow goes to a block 358 where a second signal is stored in the memory location M(S). If the boat speed V is greater than V2, logic flow goes to a block 360 where a third signal is stored in the memory location M(S).

Logic flow goes to a block 362 where reading operation is performed to store a yaw angle W. Logic flow then goes to a block 364 where the differential of yaw angle is calculated and stored as a yaw angle rate W (W overdot). Logic flow goes to a decision block 368 where a determination is made as to whether the stored yaw angle rate W (W overdot) is less than a predetermined yaw angle rate dWo. If the answer is affirmative, logic flow goes to a block 370 where a first output is stored in a memory location M(Y). If the answer at the block 368 is negative, logic flow goes to a block 372 where a second output is stored in the memory location M(Y).

Logic flow goes to a decision block 374 where boat operation is identified based on the current contents of the memory locations M(S) and M(Y). If the first output is stored in the memory location M(S) or if the third output is stored in the memory location M(S) and at the same time the second output is stored in the memory location M(Y), logic flow goes to a block 376 where a first code is selected. If the second output is stored in the memory location M(S), logic flow goes to a block 378 where a second code is selected. If the third output is stored in the memory location M(S) and the first output is stored in the memory location M(Y), logic flow goes to a block 380 where a third code is selected. Logic flow then goes to a block 382 where the selected code is stored in a memory location MODE and to an exit block 384.

Figure 23:
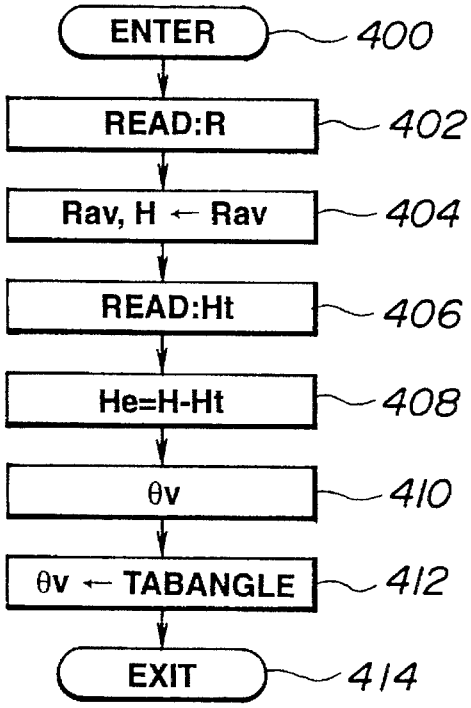
FIGS. 22 to 25 are flow charts of sub routines.

The sub routine of FIG. 23 begins at an enter block 400. Logic flow goes to a block 402 where reading operation is performed to store a roll angle R. Logic flow then goes to a block 404 where moving average of R is calculated and the result of calculation Rav (see Eq. 1) is stored as an actual heel angle H. Logic flow goes to a block 408 where an error reading operation is performed to store a target heel angle Ht. Logic flow then goes to a block 408 where an error He is calculated by subtracting the target heel angle Ht from the actual heel angle H. Logic flow goes to a block 410 where a candidate $\theta_V$ (see Eq. 2) for a target tab position is given by the equation mentioned before. Logic flow then goes to a block 412 where the candidate $\theta_V$ is stored in a memory location TABANGLE and to an exit block 414.

Figure 24:
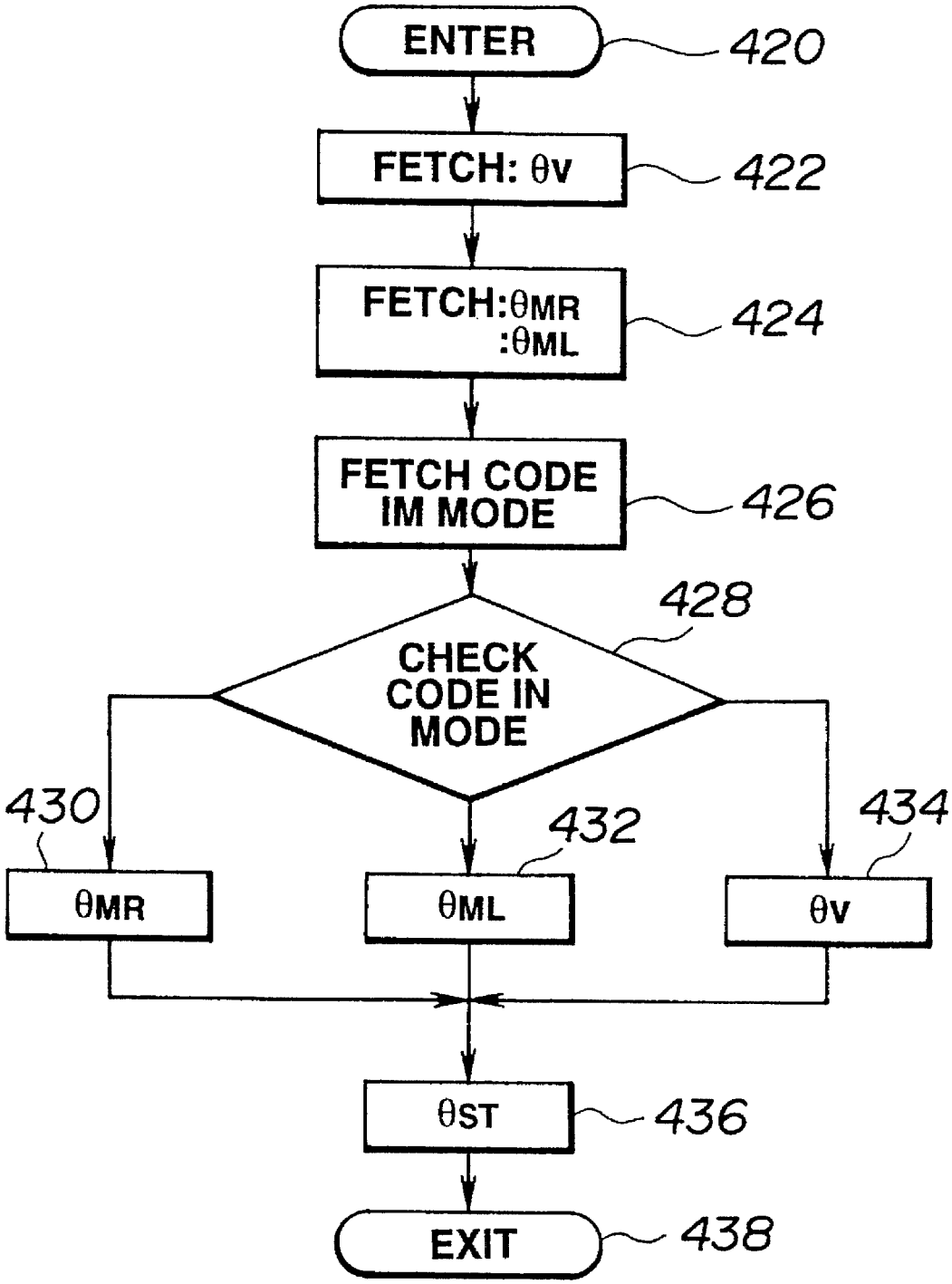

The sub routine of FIG. 24 begins at an enter block 420. Logic flow goes to a block 422 where the stored candidate $\theta_V$ for the target tab position is fetched. Logic flow then goes to a block 424 where the other two stored candidates $\theta_{MR}$ and $\theta_{ML}$ for the target tab position are fetched. Logic flow goes to a block 426 where the stored code in the memory location MODE is fetched. Logic flow goes to a decision block 428 where the code obtained at the block 426 is identified. If the code identified is the first code, logic flow goes to a block 430 where the candidate $\theta_{MR}$ is selected for the target tab position. If the code identified is the second code, logic flow goes to a block 432 where the candidate $\theta_{ML}$ is selected for the target tab position. If the code identified is the third code, logic flow goes to a block 434 where the candidate $\theta_V$ is selected for the target tab position. Logic flow then goes to a block 436 where the selected candidate is stored as the target tab position $\theta_{ST}$ and to an exit block 438.

Figure 25:
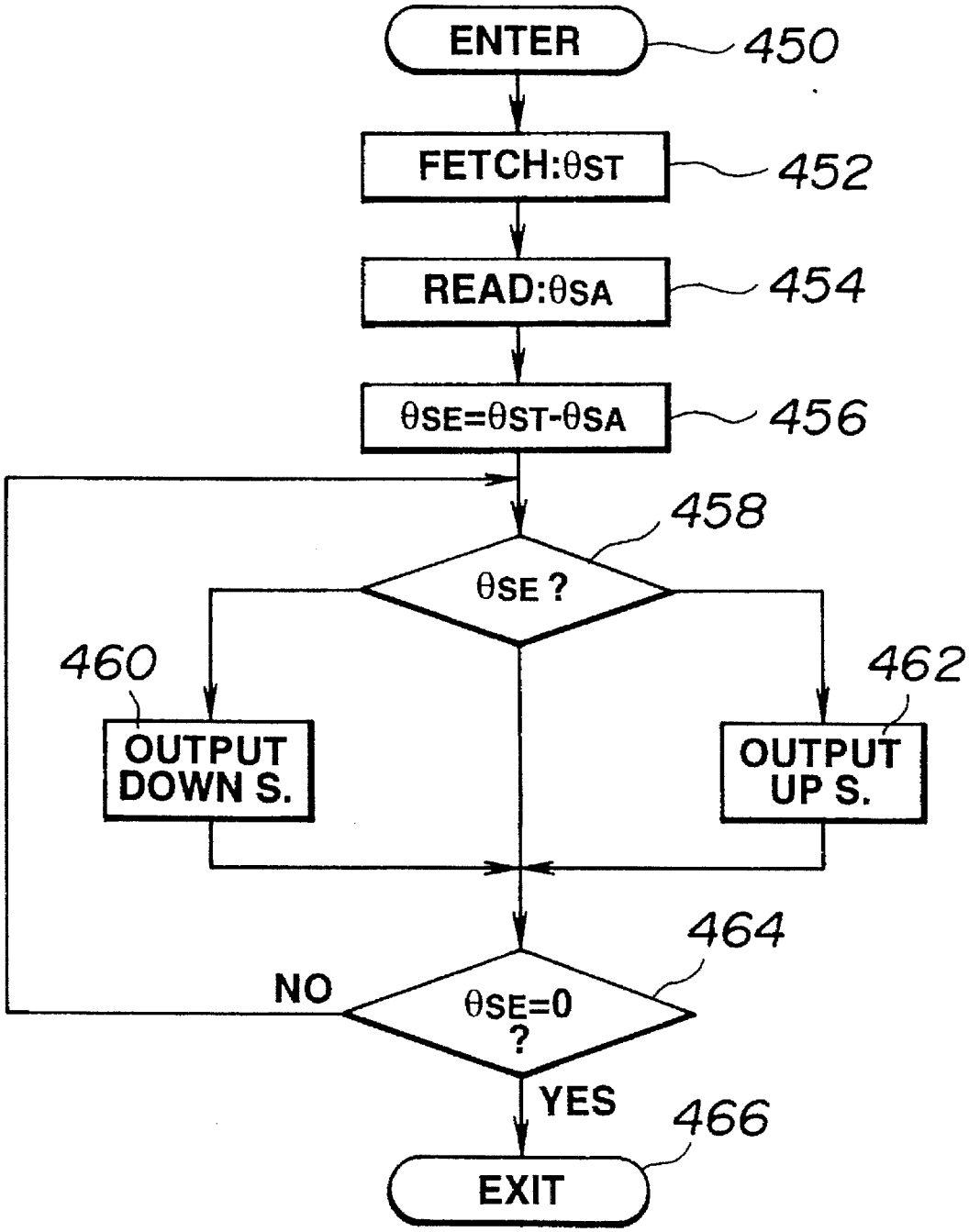

The sub routine of FIG. 25 begins at an enter block 450. Logic flow goes to a block 452 where the target tab position $\theta_{ST}$ is fetched. Logic flow goes to a block 454 where reading operation is performed to store an actual tab position $\theta_{SA}$. Logic flow goes to a block 456 where an error $\theta_{SE}$ is calculated by subtracting $\theta_{SA}$ from $\theta_{ST}$. Logic flow goes to a block 458 where determination is made as to whether the error $\theta_{SE}$ is postive or negative or zero. If the error $\theta_{SE}$ is positive, logic flow goes to a block 460 where a down signal is output to a starboard motor 60. If the error $\theta_{SE}$ is negative, an up signal is output to the starboard motor 54. If the error $\theta_{SE}$ is zero, logic flow goes to a decision block 464 where determination is made as to whether the error $\theta_{SE}$ is zero. Logic flow goes to this block 464 from the blocks 460 and 462. If the answer at the block 464 is negative, logic flow returns to the decision block 458. If the answer at the block 464 is affirmative, logic flow goes to an exit block 464.

The sub routines of FIGS. 24 and 25 are adapted for control of the starboard motor 54 which in turn moves a starboard tab 38. Sub routines for control of a port motor 44 are substantially the same in logic to the sub routines for the control of starboard motor 54.

Figure 26:
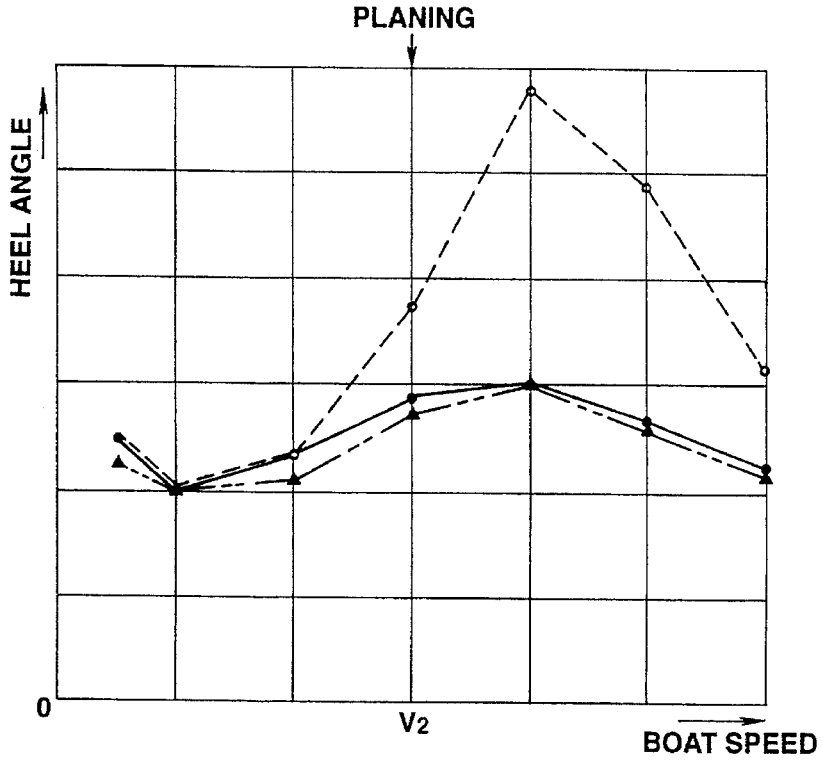
FIG. 26 is a graph plotting the relationship between heel angle and boat speed.

FIG. 26 shows heel angle readings measured at various boat speed values including the speed V2 when the boat 18 travels straight forward through beam wind. Plotted data interconnected by dotted line have resulted from operating the boat 18 without any control. Plotted data interconnected by two-dot chain line have resulted from operating the boat 18 with rolling control over the whole ranges of boat operation. Plotted data interconnected by fully drawn line have resulted from operating the boat 18 with the trim and heel control according to the embodiment of the present invention. It is understood that the trim and heel control according to the embodiment can suppress heel angle over the whole ranges of boat operation effectively as much as the rolling control which is conducted over the whole ranges of boat operation. It is appreciated that the motors 44 and 54 operates in response to error in heel angle, i.e., the moving average of roll angle, while the boat 18 is travelling straight forward in an on-plane condition, so that the amount of load which the motors 44 and 54 are subjected to have been reduced remarkably and the endurability and reliability have been enhanced.

Figure 27:
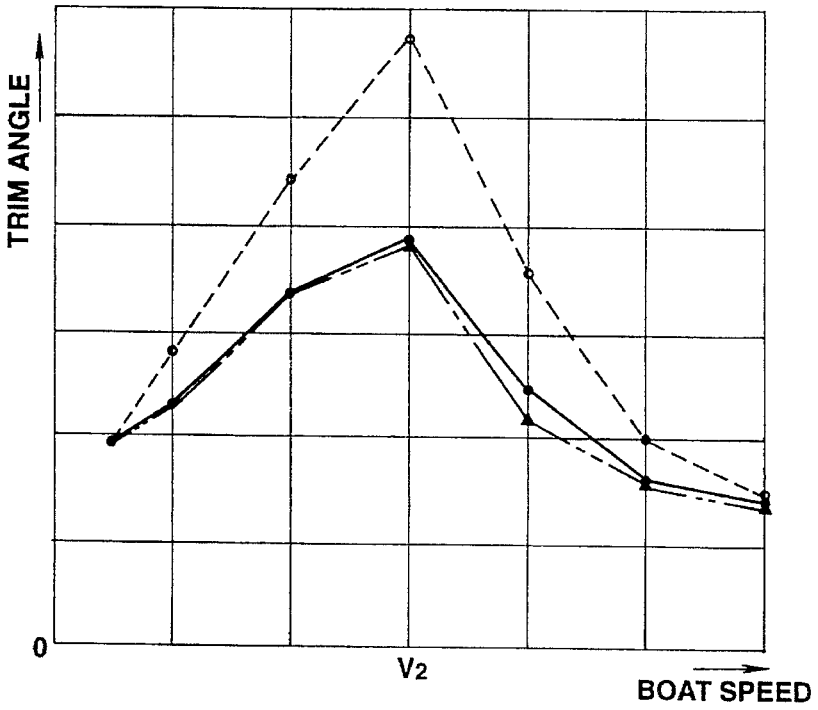
FIG. 27 is a graph plotting the relationship between trim angle and boat speed.

FIG. 27 shows trim angle readings measured at various boat speed values including the speed V2 when the boat 18 travels straight forward. Plotted data interconnected by dotted line have resulted from operating the boat 18 without any control. Plotted data interconnected by two-dot chain line have resulted from operating the boat 18 with pitching control over the whole ranges of boat operation. Plotted data interconnected by fully drawn line have resulted from operating the boat 18 with the trim and heel control according to the embodiment of the present invention. It is understood that the trim angle is suppressed well during operation in an on-plane condition.

What is claimed is:

1. An apparatus to adjust the position of a marine transportation system including a boat having a drive, a trimmable port tab and a trimmable starboard tab, the apparatus comprising:

first sensing means for monitoring the operation of the marine transportation system to provide an output distinguishing boat operation in an on-plane condition and boat operation in an off-plane condition;

second sensing means for monitoring the operation of the marine transportation system to provide an output distinguishing boat travel in a straight forward condition and boat travel in a turning condition;

third sensing means for monitoring the operation of the marine transportation system to provide an output distinguishing boat operation in a first heel condition in which the boat tilts to port and boat operation in a second heel condition in which the boat tilts to starboard; and tab trimming means operable by said first, second and third sensing means to position the port tab at a desired position and the starboard tab at a desired position in response to said outputs of said first, second and third sensing means.

2. An apparatus as claimed in claim 1, wherein said first sensing means provides a first output in response to a sensed on-plane condition and a second output in response to a sensed off-plane condition.

3. An apparatus as claimed in claim 2, wherein said second sensing means provides a first output in response to a sensed straight forward condition and a second output in response to a sensed turning condition.

4. An apparatus as claimed in claim 3, wherein said third sensing means provides a first output in response to a sensed first heel condition and a second output in response to a sensed second heel condition.

5. An apparatus as claimed in claim 4, wherein said trimming means is operable to transfer the port and starboard tabs to a maximum raised trimmed-out position, a maximum lowered trimmed-in position and a plurality of trim positions between said maximum raised trimmed-out position and maximum lowered trimmed-in position.

6. An apparatus as claimed in claim 5, wherein said trimming means is operable in response to said first output of said third sensing means in the presence of said first output of said first sensing means and said first output of said second sensing means to operate the port tab at a desired one of said plurality of trim positions, while said trimming means is operable in response to said second output of said third sensing means in the presence of said first sensing means and said second output of said second sensing means to operate the starboard tab at a desired one of said plurality of trim positions.

7. An apparatus as claimed in claim 5, wherein said trimming means is operable in response to said first output of said third sensing means in the presence of said first output of said first sensing means and said first output of said second sensing means to operate the port tab at a desired one of said plurality of trim positions with the starboard tab held at said maximum raised trimmed-out position, while said trimming means is operable in response to said second output of said third sensing means in the presence of said first sensing means and said second output of said second sensing means to operate the starboard tab at a desired one of said plurality of trim positions with the port tab held at said maximum raised trimmed-out position.

8. An apparatus as claimed in claim 7, wherein said trimming means is operable in response to a change of said output of said second sensing means from said first output thereof to said second output thereof to transfer the port and starboard tabs to said maximum raised trimmed-out position.

9. An apparatus as claimed in claim 8, wherein said trimming means is operable in response to said second output of said first sensing means to operate the port and starboard tabs at said maximum lowered trimmed-in position.

10. An apparatus as claimed in claim 1, wherein said first sensing means includes a speed sensor to sense the operating speed of the boat to provide said distinguishing output thereof.

11. An apparatus as claimed in claim 1, wherein said second sensing means includes a yaw angle sensor to sense the operating yawing of the boat to provide said distinguishing output thereof.

12. An apparatus as claimed in claim 1, wherein said third sensing means includes a roll angle sensor to sense the operating rolling of the boat to provide said distinguishing output thereof.

13. An apparatus as claimed in claim 1, wherein said third sensing means includes a rate gyroscope to provide a signal indicative of an angular velocity which the boat is subjected to during rolling and an integrator connected to said rate gyroscope to receive said angular velocity indicative signal therefrom to provide a roll angle signal indicative a roll angle of the boat.

14. An apparatus as claimed in claim 13, wherein said third sensing means includes a moving average calculator to calculate a moving average beased on a roll angle reading and the prior readings to provide a signal indicative of said calculated moving average as a heel angle, and a heel comparator connected to said moving average calculator to compare said heel angle with a predetermined heel angle to provide said distinguishing output of said third sensing means.

15. An apparatus as claimed in claim 1, wherein said third sensing means includes an accelerometer to provide a signal indicative of an angular acceleration which the boat is subjected to during rolling, thereby to provide said distinguishing output thereof.

16. An apparatus as claimed in claim 1, wherein said third sensing means includes an inclinometer to provide a signal indicative of a roll angle through which the boat tilts during rolling, thereby to provide said distinguhsing output of said third sensing means.

17. An apparatus as claimed in claim 1, wherein said second sensing means includes a direction finder of magnetic type to provide, as a yaw angle, a signal indicative of a deviation of the boat from the straight forward direction, thereby to provide said distinguishing output of said second sensing means.

18. An apparatus to adjust the position of a marine transportation system including a boat having a drive, a trimmable port tab and a trimmable starboard tab, the apparatus comprising:

means for generating a boat speed signal indicative of a boat speed;

means for generating a roll angle signal indicative of a roll angle through which the boat tilts during rolling;

means for generating a yaw angle signal indicative of a yaw angle through which the boat turns during yawing;

controller means operable in response to said boat speed signal, roll angle signal and yaw angle signal to generate an output signal distinguishing one boat operating condition from another; and tab trimming means operable in response to said output signal of said controller means to position the port and starboard tabs.

19. An apparatus to adjust the position of a marine transportation system including a boat having a drive, a trimmable port tab and a trimmable starboard tab, the apparatus comprising:

means for generating a boat speed signal indicative of a boat speed;

means for generating a roll angle signal indicative of a roll angle through which the boat tilts during rolling;

means for generating a yaw angle signal indicative of a yaw angle through which the boat turns during yawing;

means for generating tab position signals indicative of positions of the port and starboard tabs;

controller means operable in response to said boat speed signal, roll angle signal, yaw angle signal and tab position signals to generate an output signal; and tab trimming means operable in response to said output signal of said controller means to position the port and starboad tabs.

20. An apparatus to adjust the position of a marine transportation system including a boat having a drive, a trimmable port tab and a trimmable starboard tab, the apparatus comprising:

controller means operable to generate an output signal in response to varying boat operating condition;

tab trimming means operable in response to said output signal of said controller means to position the port and starboad tabs;

means for generating a boat speed signal indicative of boat speed;

means for generating a rolling angle signal indicative of a roll angle through which the boat tilts during rolling;

means for generating a yaw angle signal indicative of a yaw angle through which the boat turns during yawing; and means for generating tab position signals indicative of positions of the port and starboard tabs, said controller means being operable in response to said boat speed signal and yaw angle signal to distinguish one boat operating condition from another and operable in response to said roll angle signal and said tab position signals to generate said output signal.

21. An apparatus as claimed in claim 20, wherein said controller means is operable to automatically select trim-in operation, trim-out operation and heel adjustment operation in response to the varying boat operating conditions.

22. An apparatus as claimed in claim 21, wherein said controller means is operable to carry out heel adjustment operation when said boat speed signal and said yaw angle signal represents a predetermined boat operation.

23. An apparatus as claimed in claim 21, wherein said controller means is operable to carry out said trim-out operation when said boat speed signal and said yaw angle signal represents establishment of a boat travel in turning.

24. An apparatus as claimed in claim 21, wherein said controller means is operable to carry out said trim-in operation when said boat speed signal represents a boat operation with a bow lifted.

25. An apparatus as claimed in claim 20, including an auto-manual control which is conditioned for automatic operation to enable said tab trimming means to respond to said output of said controller means, said auto-manual control being conditioned for manual operation to disable said tab trimming means and to position the port and starboard tabs by manipulation of port and starboard tab manual switches.

26. An apparatus to adjust the position of a marine transportation system including a boat having a drive, a trimmable port tab and a trimmable starboard tab, the apparatus comprising:

contoller means operable to generate an output signal in response to varying boat operating condition;

tab trimming means operable in response to said output signal of said controller means to position the port and starboad tabs.

means for generating a boat speed signal indicative of a boat speed;

means for generating a roll angle signal indicative of a roll angle through which the boat tilts during rolling;

means for generating a yaw angle signal indicative of a yaw angle through which the boat turns during yawing; and means for generating tab position signals indicative of acutal positions of the port and starboard tabs, said controller means being operable to read said yaw angle signal and to compare the latest yaw angle reading with the prior reading to determine a yaw angle rate, said controller means being operable to read said boat speed signal;

said controller means being operable in response to said determined yaw angle rate and the lastest boat speed reading to distinguish one boat operating condition from another, said controller means being operable to read said roll angle signal and to compute an average of the latest roll angle reading and the prior readings to provide said average as a heel angle, said controller means being operable to compare said heel angle with a target heel angle to determine an error therebetween, said controller means being operable in response to boat operating condition and in response to said determined error to provide a tab target position command, and said controller means being operable in response to said tab target position command and said tab position signals to provide tab control signals as said output of said controller means.

27. A method of adjusting the position of a marine transportation system including a boat having a drive, a trimmable port tab and a trimmable starboard tab, the method comprising the steps of:

monitoring the operation of the marine transportation system to provide an output distinguishing boat operation in an on-plane condition and boat operation in an off-plane condition;

monitoring the operation of the marine transportation system to provide an output distinguishing boat travel in a straight forward condition and boat travel in a turning condition;

monitoring the operation of the marine transportation system to provide an output distinguishing boat operation in a first heel condition in which the boat tilts to port and boat operation in a second heel condition in which the boat tilts to starboard; and positioning the port tab at a desired position and the starboard tab at a desired position in response to said outputs.

* * * * *